US006443837B1

(12) United States Patent
Jaffe et al.

(10) Patent No.: US 6,443,837 B1
(45) Date of Patent: Sep. 3, 2002

(54) BONUS GAMES FOR GAMING MACHINES WITH STRATEGY OPTIONS

(75) Inventors: Joel R. Jaffe, Evanston, IL (US); Damon E. Gura, Chicago, IL (US); Erica Frohm, Evanston, IL (US)

(73) Assignee: WMS Gaming Inc., Chicago, IL (US)

( * ) Notice: Subject to any disclaimer, the term of this patent is extended or adjusted under 35 U.S.C. 154(b) by 0 days.

(21) Appl. No.: 09/318,903

(22) Filed: May 26, 1999

(51) Int. Cl.[7] ..... A63F 9/24
(52) U.S. Cl. ..... 463/16; 463/25
(58) Field of Search ..... 463/16–20, 21, 463/25, 26–28, 30, 31, 1, 11–15, 22, 32–34, 37, 43; 273/138.1, 139, 143 R, 273

(56) References Cited

U.S. PATENT DOCUMENTS

| | | | |
|---|---|---|---|
| 3,281,149 | A | 10/1966 | Miller |
| 4,095,795 | A | 6/1978 | Saxton et al. |
| 4,306,768 | A | 12/1981 | Egging |
| 4,335,809 | A | 6/1982 | Wain |
| 4,448,419 | A | 5/1984 | Telnaes |
| 4,508,345 | A | 4/1985 | Okada |
| 4,624,459 | A | 11/1986 | Kaufman |
| 4,721,307 | A | 1/1988 | Okada |
| 4,763,256 | A | 8/1988 | DeMar |
| 4,772,023 | A | 9/1988 | Okada |
| 4,805,907 | A | 2/1989 | Hagiwara |
| 4,871,171 | A | 10/1989 | Rivero |
| 5,083,785 | A | 1/1992 | Okada |
| 5,169,147 | A | 12/1992 | Hamano |
| 5,205,555 | A | 4/1993 | Hamano |
| 5,259,616 | A | 11/1993 | Bergmann |
| 5,292,127 | A | 3/1994 | Kelly et al. |
| 5,342,047 | A | 8/1994 | Heidel et al. |
| 5,342,049 | A | 8/1994 | Wichinsky et al. |
| 5,380,008 | A | 1/1995 | Mathis et al. |
| 5,393,057 | A | 2/1995 | Marnell, II |

(List continued on next page.)

FOREIGN PATENT DOCUMENTS

| | | |
|---|---|---|
| DE | 37 00 861 | 7/1988 |
| DE | 40 14 477 | 7/1991 |
| EP | 0 142 371 | 5/1985 |

(List continued on next page.)

OTHER PUBLICATIONS

Product Sheet for Battter Up!, WMS Gaming Inc., 1 page (no date).
Brochure of Monopoly SWP Game; JPM Ltd., 4 pgs.; date unknown.
WMS' Big Money Advertisement Sheet; WMS Gaming Inc.; 1 pg.; date unknown.

(List continued on next page.)

*Primary Examiner*—Joe H. Cheng
*Assistant Examiner*—K. Nguyen
(74) *Attorney, Agent, or Firm*—Jenkens & Gilchrist

(57) ABSTRACT

A gaming machine bonus feature involving the selection of strategy options. The player selects strategy options, one at a time, in successive game stages. Each of the strategy options is associated with a game activity having a number of possible outcomes. After selection of the strategy options, a gaming machine processor determines the outcomes associated with the designated game activity. In one embodiment, the game program defines a selection probability for the possible outcomes which may vary in the successive game stages.

In accordance with another aspect of the present invention, there is provided a gaming machine and method of operating of the gaming machine to execute a game program defining a first and second strategy option. Each of the first and second strategy options are associated with a designated game activity. The method comprises a first step of selecting, under player control, one of the first and second strategy options. The processor identifies the designated game activity associated with the selected strategy option and a number of possible outcomes of the designated game activity. Then, the processor selects one of the possible outcomes and the gaming machine displays indicia of the selected outcome.

29 Claims, 12 Drawing Sheets

U.S. PATENT DOCUMENTS

| | | | | | |
|---|---|---|---|---|---|
| 5,401,024 | A | | 3/1995 | Simunek | |
| 5,415,404 | A | | 5/1995 | Joshi et al. | |
| 5,429,361 | A | | 7/1995 | Raven et al. | |
| 5,449,173 | A | | 9/1995 | Thomas et al. | |
| 5,456,465 | A | | 10/1995 | Durham | |
| 5,456,466 | A | | 10/1995 | Miles | |
| 5,542,669 | A | | 8/1996 | Charron et al. | |
| 5,547,192 | A | | 8/1996 | Ishibashi | |
| 5,575,717 | A | * | 11/1996 | Houriet, Jr. et al. | 463/1 |
| 5,624,119 | A | | 4/1997 | Leake | |
| 5,647,798 | A | | 7/1997 | Falciglia | |
| 5,664,781 | A | | 9/1997 | Feola | |
| 5,697,843 | A | | 12/1997 | Manship et al. | |
| 5,704,835 | A | | 1/1998 | Dietz, II | |
| 5,722,891 | A | | 3/1998 | Inoue | |
| 5,769,714 | A | | 6/1998 | Wiener et al. | 463/3 |
| 5,772,509 | A | * | 6/1998 | Weiss | 463/16 |
| 5,779,545 | A | | 7/1998 | Berg et al. | |
| 5,788,573 | A | | 8/1998 | Baerlocher et al. | |
| 5,823,874 | A | | 10/1998 | Adams | |
| 5,848,932 | A | | 12/1998 | Adams | |
| 5,951,397 | A | | 9/1999 | Dickinson | 463/36 |
| 6,007,427 | A | | 12/1999 | Wiener et al. | 463/17 |
| 6,059,289 | A | * | 5/2000 | Vancura | 273/143 R |
| 6,089,976 | A | * | 7/2000 | Schneider et al. | 463/16 |
| 6,117,009 | A | * | 9/2000 | Yoseloff | 463/20 |
| 6,135,884 | A | * | 10/2000 | Hedrick et al. | 463/20 |
| 6,135,885 | A | | 10/2000 | Lermusiaux | 463/20 |
| 6,159,098 | A | * | 12/2000 | Slomiany et al. | 463/25 |
| 6,165,071 | A | | 12/2000 | Weiss | 463/24 |

FOREIGN PATENT DOCUMENTS

| | | |
|---|---|---|
| EP | 0 148 001 | 7/1985 |
| EP | 0 333 338 | 9/1989 |
| EP | 0 577 415 A2 | 1/1994 |
| FR | 1 474 617 | 4/1966 |
| GB | 1129607 | 10/1968 |
| GB | 1 476 848 | 6/1977 |
| GB | 1 591 623 | 6/1981 |
| GB | 2 066 991 | 7/1981 |
| GB | 2 072 395 | 9/1981 |
| GB | 2 083 936 | 3/1982 |
| GB | 2 084 371 | 4/1982 |
| GB | 2 096 376 | 10/1982 |
| GB | 2 097 160 | 10/1982 |
| GB | 2 105 891 | 3/1983 |
| GB | 2 106 685 | 4/1983 |
| GB | 2 117 952 | 10/1983 |
| GB | 2 147 442 | 5/1985 |
| GB | 2 147 773 | 5/1985 |
| GB | 2 152 262 | 7/1985 |
| GB | 2 153 572 | 8/1985 |
| GB | 2 157 047 | 10/1985 |
| GB | 2 165 385 | 4/1986 |
| GB | 2 170 636 | 8/1986 |
| GB | 2 180 087 | 3/1987 |
| GB | 2 181 589 | 4/1987 |
| GB | 2 183 882 | 6/1987 |
| GB | 2 191 030 | 12/1987 |
| GB | 2 197 974 | 6/1988 |
| GB | 2 202 984 | 10/1988 |
| GB | 2 204 436 | 11/1988 |
| GB | 2 210 191 | 6/1989 |
| GB | 2 222 712 | 3/1990 |
| GB | 2 226 907 | 7/1990 |
| GB | 2 229 565 | 9/1990 |
| GB | 2 230 373 | 10/1990 |
| GB | 2 233 806 | 1/1991 |
| GB | 2 242 300 | 9/1991 |
| GB | 2 253 154 | 9/1992 |
| GB | 2 262 642 | 6/1993 |
| GB | 2 270 787 | 3/1994 |
| GB | 2 273 384 | 8/1994 |
| GB | 2 287 567 | 9/1995 |
| GB | 2 297 857 | 8/1996 |
| GB | 2 298 508 | 9/1996 |
| WO | WO 8808179 | 10/1988 |
| WO | WO 8912875 | 12/1989 |
| WO | WO 9210818 | 6/1992 |
| WO | WO 9401840 | 1/1994 |

OTHER PUBLICATIONS

WMS' Piggy Bankin' Advertisement Sheet; WMS Gaming Inc.; 1 pg.; date unknown.

WMS' Pirate's Thunder Advertisement Sheet; WMS Gaming Inc., 1 pg.; date unknown.

Bally Circus Ad, excerpt from "Lemons, Cherries and Bell Fruit Gum"; Richard M. Bueschel; 3 pgs.; date unknown.

Bally Bingo Ad, excerpt from "Lemons, Cherries and Bell Fruit Gum"; Richard M. Bueschel; 1 pg.; date unknown.

Las Vegas Slot Machine Ad, excerpt from "Lemons, Cherries and Bell Fruit Gum"; Richard M. Bueschel; 1 pg.; date unknown.

Phantom Haus website publication; Williams Electronics Games, Inc.; 2 pgs.; date unknown.

Arabian Riches website publication; Silicon Gaming Inc.; 2 pgs.; date Jul. 17, 1998.

Buccaneer Gold website publication; Silicon Gaming Inc.; 2 pgs.; date Jul. 17, 1998.

Fort Knox website publication; Silicon Gaming Inc.; 2 pgs.; date Jul. 17, 1998.

Lady of Fortune website publication; Silicon Gaming Inc.; 2 pgs.; date Jul. 17, 1998.

Riddle of the Sphinx website publication; Silicon Gaming Inc.; 2 pgs.; date Jul. 17, 1998.

Information Sheets for Kaleidoscope game; Williams Electronics Games, Inc.; 3 pgs.; date unknown.

Information Sheets for Double Wild & Loose Game; Williams Electronics Games, Inc.; 3 pgs.; date unknown.

Information Sheets for Wild Cherry (120A) Game; International Game Technology.; 2 pgs.; date Nov. 7, 1994.

Information Sheets for Double Wild Cherry (195A) Game; International Game Technology.; 3 pgs.; date Nov. 7, 1994.

Chapters 10, 11, 12; excerpts from "Lemons, Cherries and Bell–Fruit–Gum"; Richard M. Bueschel; 71 pgs.; 1995.

Advertisement, Club Vegas, Barcrest; 1 pg.; date unknown.

Advertisement, Viva Club Vegas!, Barcrest; 1 pg.; date unknown.

Advertisement, "Monopoly: Maygay There for the Taking"; 2 pgs.; date unknown.

Advertisement, "The Big Breakfast"; Channel Four Television Corporation; 2 pgs.; 1993.

Advertisement, "Midas Touch"; 2 pgs.; date unknown.

Advertisement, "Acropolis"; Automatic (Fruit) Designs, Ltd.; 2 pgs.; date unknown.

Advertisement, "Adders & Ladders"; Barcrest; 2 pgs.; date unknown.

Advertisement, "The Wild West"; Bell–Fruit Manufacturing; 2 pgs.; date unknown.

Advertisement, "Premier Club Manager"; Bell–Fruit Manufacturing; 2 pgs.; date unknown.

Advertisement, "Fortune Wheel"; Project Customer Services; 2 pgs.; date unknown.

Advertisement, "Road Hog"; Barcrest; 2 pgs.; date unknown.
Advertisement,"Viva! Six! Las Vegas"; Barcrest; 2 pgs.; date unknown.
Advertisement, "Golden Circle"; Delta Automaten; 1 pg.; date unknown.
Advertisement, "Club Double"; M–D–M Coin Sales Ltd.; 2 pgs.; date unknown.
Advertisement, "Treasure Island"; American Alpha, Inc.; 1 pg.; date unknown.
Advertisement, "Bonus Card"; Andries Robert Automatic s.p.r.l.; 1 pg.; date unknown.
Advertisement, "Super Square"; Maygay Machines Ltd.; 2 pgs.; date unknown.
Advertisement, "Lucky Bank"; 1 pg.; date unknown.
Advertisement, "Happy Clown"; Andries Robert Automatic s.p.r.l.; 1 pg.; date unknown.
Advertisement, "Jackpot Stampede"; WMS Gaming Inc.; 2 pgs.; date unknown.
Brochure, "Perfect Universal Slot Machines"; Universal Co., Ltd.; 16 pgs.; date unknown.
Advertisement, "Club Make a Million"; Bell–Fruit Manufacturing Co., Ltd.; 2 pgs.; date unknown.
Advertisement, "Instant Jackpots"; Bell–Fruit Manufacturing Co., Ltd.; 2 pgs.; date unknown.
Cover page, "Enter Disposable Gaming"; *Euroslot. The International Coin–Operated Machine Journal*; 1 pg.; Apr., 1994.
Advertisement, Barcrest Limited; 1 pg.; date unknown.
Cover page, "Covers Your World"; *Euroslot. The Currency of the Coin Machine Industry*; 1 pg.; date unknown.
Article, "Bangkok on the Brink"; *Euroslot. The International Coin–Operated Machine Journal*; 2 pgs.; Nov., 1993.
Article, "Scandinavia on the Brink of the EU melting pot"; *Euroslot. The International Coin–Operated Machine Journal*; 2 pgs.; Aug., 1994.
Advertisement, "Only Fools and Horses"; Bell–Fruit Manufacturing Co., Ltd.; 2 pgs.; date unknown.
Advertisement, "Main Attraction"; Bell–Fruit Manufacturing Co., Ltd., 2 pgs.; date unknown.
Brochure, "World Players"; Barcrest; 6 pgs.; date unknown.
Brochure, "JPM Presents Monopoly Deluxe"; JPM International Ltd.; 5 pgs.; date unknown.
Brochure, "The 50th Show"; Ate International; 2 pgs.; Jan., 1994.
Advertisement, "Colossus"; AFD.; 1 pg.; date unknown.
Advertisement, "Wheel of Fortune"; Project Creating Entertainment; 2 pgs.; date unknown.
Advertisement, "Lucky Horseshoes"; JPM Automatic Machines Ltd.; 2 pgs.; date unknown.
Advertisement, "Lucky Jackpots"; JPM Automatic Machines Ltd.; 2 pgs.; date unknown.
Advertisement, "Monopoly"; JPM Automatic Machines Ltd.; 2 pgs.; date unknown.

* cited by examiner

BONUS GAMES FOR GAMING MACHINES WITH STRATEGY OPTIONS

FIELD OF THE INVENTION

The present invention relates generally to gaming machines offering bonus games and, more particularly, to bonus games which offer strategy options to the player.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available, because such machines attract frequent play and hence increase profitability to the operator.

One concept which has been successfully employed to enhance the entertainment value of a game is the concept of a "secondary" or "bonus" game which may be played in conjunction with a "basic" game. The bonus game may comprise any type of game, either similar to or completely different from the basic game, which is entered upon the occurrence of a selected event or outcome of the basic game. Generally, bonus games provide a greater expectation of winning than the basic game and may also be accompanied with more attractive or unusual video displays and/or audio. Because the bonus game concept offers tremendous advantages in player appeal and excitement relative to other known games, and because such games are attractive to both players and operators, there is a continuing need to develop gaming machines with new types of bonus games to satisfy the demands of players and operators. The present invention is directed to satisfying this need.

SUMMARY OF THE INVENTION

In accordance with one aspect of the present invention, there is provided a gaming machine with a bonus feature involving the selection of strategy options. The gaming machine operates under processor control to execute a game program defining the strategy options. The strategy options are selectable, under player control. The processor operates to perform game activities associated with the selected strategy options and credits are awarded based on the outcomes of the game activities. In one embodiment, the game program defines a succession of game stages in which case the performance of game activities comprises the following steps, accomplished under processor control in at least one of the game stages: (1) identifying a designated game activity associated with a selected strategy option; (2) identifying a number of possible outcomes of the designated game activity; and (3) selecting one of the possible outcomes associated with the designated game activity. In one embodiment, the game program defines a selection probability for the possible outcomes which may vary in the successive game stages.

In accordance with another aspect of the present invention, there is provided a gaming machine and method of operating of the gaming machine to execute a game program defining a first and second strategy option. Each of the first and second strategy options are associated with a designated game activity. The method comprises a first step of selecting, under player control, one of the first and second strategy options. The processor identifies the designated game activity associated with the selected strategy option and a number of possible outcomes of the designated game activity. Then, the processor selects one of the possible outcomes and the gaming machine displays indicia of the selected outcome.

BRIEF DESCRIPTION OF THE DRAWINGS

The foregoing and other advantages of the invention will become apparent upon reading the following detailed description and upon reference to the drawings in which.

Figure 1:
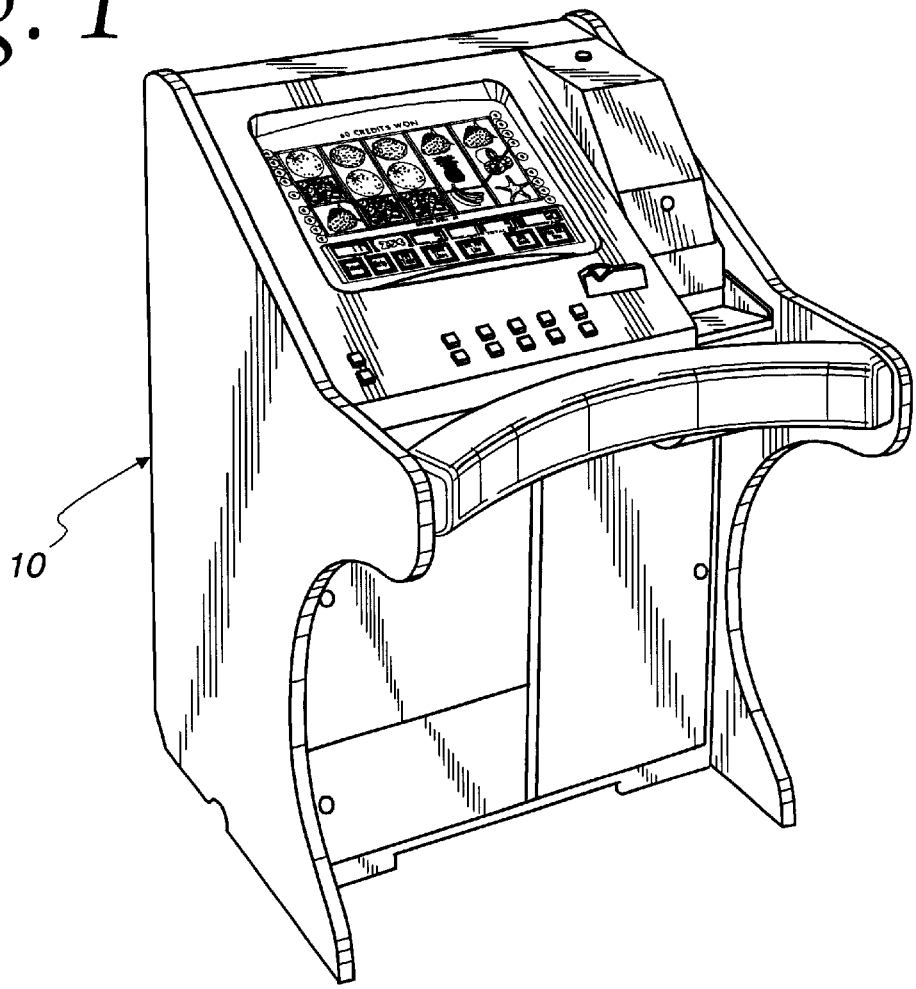
FIG. 1 is a perspective view of a video gaming machine operable to implement a bonus game with strategy options according to one embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, there is depicted a video gaming machine 10 which may be used to implement a bonus game with strategy options according to the present invention. The gaming machine 10 includes a video display 12 which may comprise a dot matrix, CRT, LED, LCD, electro-luminescent display or generally any type of video display known in the art. In the illustrated embodiment, the video gaming machine 10 comprises a "slant-top" version, in which the video display is slanted at about a thirty-degree angle toward the player. It will be appreciated, however, that any of several other models of gaming machines are within the scope of the present invention including, for example, "upright" versions in which the video display 12 is oriented vertically relative to the player, or gaming machines which include mechanical, rather than video displays.

In one embodiment, the gaming machine 10 is operable to play a game entitled TOP BANANA™ which has a beach party theme. The TOP BANANA™ game features a basic game in the form of a slot machine with five simulated spinning reels (see FIG. 3) and a bonus game with strategy options directing game activities on the video display 12. It will be appreciated, however, that the gaming machine 10 may be implemented with games other than the TOP BANANA™ game and/or with any of several alternative game themes.

Figure 2:
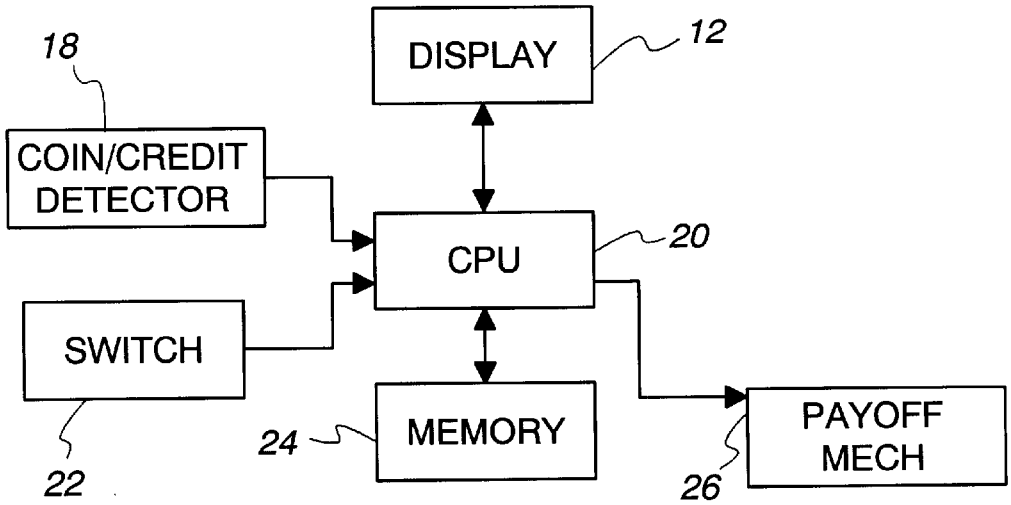
FIG. 2 is a block diagram of the video gaming machine of FIG. 1.

FIG. 2 is a block diagram of a control system suitable for operating the gaming machine 10. Coin/credit detector 18 signals a CPU 20 when a player has inserted a number of coins or played a number of credits. Then, the CPU 20 operates to execute a game program which causes the video display 12 to display the basic game which includes simulated reels with symbols displayed thereon (see FIG. 3). The basic game commences in response to the player activating a switch 22 (e.g., by pulling a lever or pushing a button), causing the CPU 20 to set the reels in motion, randomly select a game outcome and then stop the reels to display symbols corresponding to the pre-selected game outcome. In one embodiment, certain of the basic game outcomes cause the CPU 20 to enter a bonus mode causing the video display 12 to show a bonus game. The display screens associated with the TOP BANANA™ bonus game will be described in detail in relation to FIGS. 6.

A system memory 24 stores control software, operational instructions and data associated with the gaming machine 10. In one embodiment, the memory 24 comprises a separate read-only memory (ROM) and battery-backed random-access memory (RAM). However, it will be appreciated that the system memory 24 may be implemented on any of several alternative types of memory structures or may be implemented on a single memory structure. A payoff mechanism 26 is operable in response to instructions from the CPU 20 to award a payoff of coins or credits to the player in response to certain winning outcomes which might occur in the basic game or bonus game. The payoff amounts corresponding to certain combinations of symbols in the basic game is predetermined according to a pay table stored in system memory 24. The payoff amounts corresponding to certain outcomes of the bonus game are also stored in system memory 24.

Figure 3:
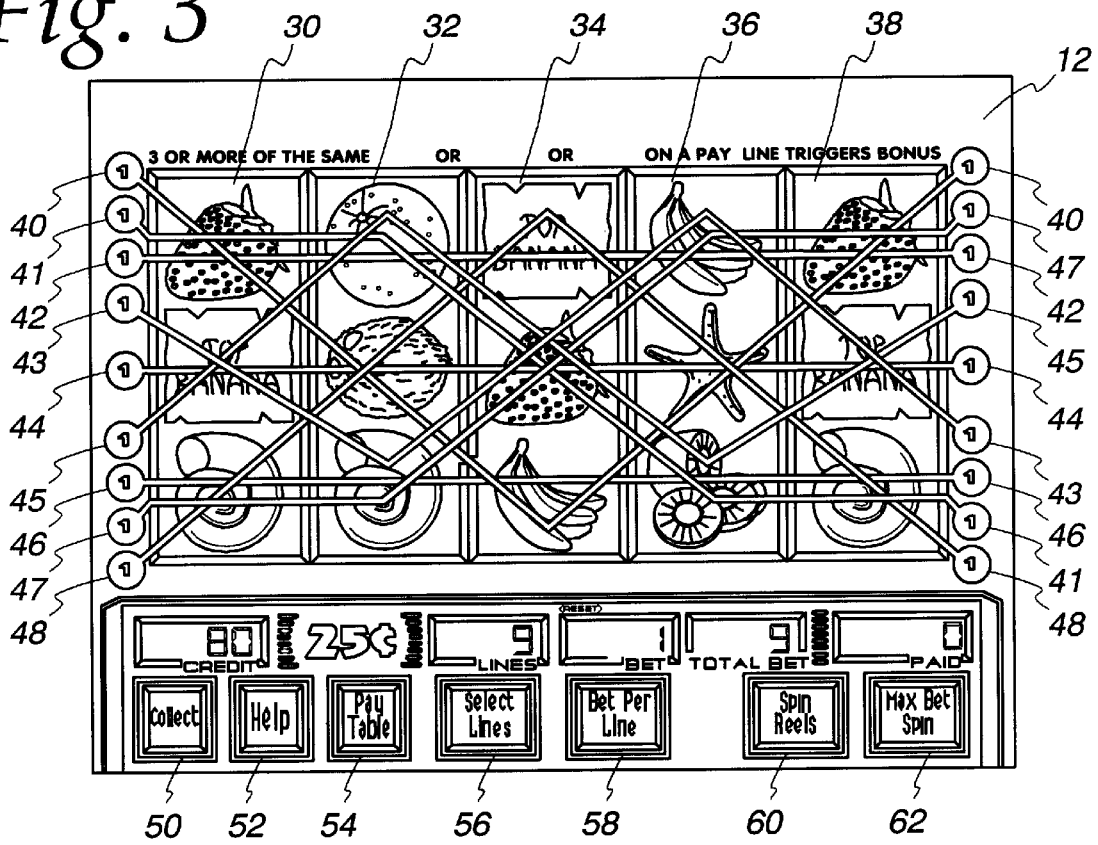
FIG. 3 is an illustration of a five-reel, nine-line basic game which is played on the video gaming machine of FIG. 1 according to one embodiment of the present invention.

As shown in FIG. 3, the TOP BANANA™ basic game is implemented on the video display 12 on five video simulated spinning reels, 30, 32, 34, 36 and 38 (hereinafter "reels") with nine paylines 40–48. Generally, game play is initiated by inserting a number of coins or playing a number of credits, causing the CPU 20 (FIG. 2) to activate a number of paylines corresponding to the number of coins or credits played. In one embodiment, the player selects the number of paylines (between one and nine) to play by pressing the "Select Lines" key 56 on the video display 12. The player then chooses the number of coins or credits to bet on the selected paylines by pressing the "Bet Per Line" key 58.

After activation of the paylines, the reels 30, 32, 34, 36 and 38 may be set in motion by touching the "Spin Reels" key 60 or, if the player wishes to bet the maximum amount per line, by using the "Max Bet Spin" key 62 on the video display 12. Alternatively, other mechanisms such as, for example, a lever or push button may be used to set the reels in motion. The CPU 20 uses a random number generator (not shown) to select a game outcome (e.g., "basic" game outcome) corresponding to a particular set of reel "stop positions." The CPU 20 then causes each of the video reels 30, 32, 34, 36 and 38 to stop at the appropriate stop position. Video symbols are displayed on the reels 30, 32, 34, 36 and 38 to graphically illustrate the reel stop position and indicate whether the stop position of the reels represents a winning game outcome. Winning "basic" game outcomes (e.g., symbol combinations resulting in payment of coins or credits) are identifiable by a pay table (see Table A-1). In one embodiment, the pay table is affixed to the machine 10 and/or displayed by the video display 12 in response to a command by the player (e.g., by pressing the "PAY TABLE" button 54). The pay table enables the player to view the winning combinations and their associated payoff amounts. If the displayed symbols stop in a winning combination, the game credits the player an amount corresponding to the award in the pay table for that combination multiplied by the amount of credits bet on the winning payline. The player may collect the amount of accumulated credits by pressing the "Collect" button 50.

In the embodiment of FIG. 3, each of the paylines 40-48 extend through one symbol on each of the five reels 30, 32, 34, 36 and 38. Payline 40 starts at the upper left symbol (e.g., "STRAWBERRY") on reel 30, extends through the center symbol (e.g., "COCONUT") on reel 32, the lower symbol (e.g., "BANANA BUNCH," hereinafter "BUNCH") on reel 34, the center symbol (e.g., "STARFISH") on reel 36 and terminates at the top symbol (e.g., "STRAWBERRY") on reel 38. Payline 41 starts at the upper left symbol (e.g., "STRAWBERRY") on reel 30, extends through the upper symbol (e.g., "ORANGE") on reel 32, the center symbol (e.g., "STRAWBERRY") on reel 34, the lower symbol (e.g., "KIWI") on reel 36 and terminates at the lower symbol (e.g., "SHELL") on reel 38. Payline 42 extends through the top symbol on each reel (e.g., "STRAWBERRY" on reel 30, "ORANGE" on reel 32, "TOP BANANA" on reel 34, "BUNCH" on reel 36 and "STRAWBERRY" on reel 38.) Payline 43 starts at the center symbol (e.g., "TOP BANANA") on reel 30, extends through the lower symbol (e.g., "SHELL") on reel 32, the center symbol (e.g., "STRAWBERRY") on reel 34, the upper symbol (e.g., "BUNCH") on reel 36 and terminates at the center symbol (e.g., "TOP BANANA") on reel 38. Payline 44 extends through the center symbol on each reel (e.g., "TOP BANANA" on reel 30, "COCONUT" on reel 32, "STRAWBERRY" on reel 34, "STARFISH" on reel 36 and "TOP BANANA" on reel 38.) Payline 45 starts at the center symbol (e.g., "TOP BANANA") on reel 30, extends through the upper symbol (e.g., "ORANGE") on reel 32, the center symbol (e.g., "STRAWBERRY") on reel 34, the lower symbol (e.g., "KIWI") on reel 36 and terminates at the center symbol (e.g., "TOP BANANA") on reel 38. Payline 46 extends through the lower symbol on each reel (e.g., "SHELL" on reel 30, "SHELL" on reel 32, "BUNCH" on reel 34, "KIWI" on reel 36 and "SHELL" on reel 38.) Payline 47 starts at the lower symbol (e.g., "SHELL") on reel 30, extends through the lower symbol (e.g., "SHELL") on reel 32, the center symbol (e.g., "STRAWBERRY") on reel 34, the upper symbol (e.g., "BUNCH") on reel 36 and terminates at the upper symbol (e.g., "STRAWBERRY") on reel 38. Payline 48 starts at the lower symbol (e.g., "SHELL") on reel 30, extends through the center symbol (e.g., "KIWI") on reel 32, the upper symbol (e.g., "TOP BANANA") on reel 34, the center symbol (e.g., "STARFISH") on reel 36 and terminates at the lower symbol (e.g., "SHELL") on reel 38.

TABLE A-1

| WIN COMBINATION | | | | | |
|---|---|---|---|---|---|
| Reel 30 | Reel 32 | Reel 34 | Reel 36 | Reel 38 | PAY |
| BANANA | BANANA | BANANA | BANANA | BANANA | 4000 |
| BANANA | BANANA | BANANA | BANANA | | 400 |
| | BANANA | BANANA | BANANA | BANANA | 400 |
| BANANA | BANANA | BANANA | | | 80 |
| | | BANANA | BANANA | BANANA | 80 |
| BANANA | BANANA | | | | 10 |
| | | | BANANA | BANANA | 10 |
| SHELL | SHELL | SHELL | SHELL | SHELL | 500 |
| SHELL | SHELL | SHELL | SHELL | | 125 |
| | SHELL | SHELL | SHELL | SHELL | 125 |
| SHELL | SHELL | SHELL | | | 60 |
| | | SHELL | SHELL | SHELL | 60 |
| SCAL | SCAL | SCAL | SCAL | SCAL | 400 |
| SCAL | SCAL | SCAL | SCAL | | 100 |
| | SCAL | SCAL | SCAL | SCAL | 100 |
| SCAL | SCAL | SCAL | | | 40 |
| | | SCAL | SCAL | SCAL | 40 |
| STAR | STAR | STAR | STAR | STAR | 300 |
| STAR | STAR | STAR | STAR | | 80 |
| | STAR | STAR | STAR | STAR | 80 |
| STAR | STAR | STAR | | | 25 |
| | | STAR | STAR | STAR | 25 |
| BUNCH | BUNCH | BUNCH | BUNCH | BUNCH | 250 |
| BUNCH | BUNCH | BUNCH | BUNCH | | 60 |
| | BUNCH | BUNCH | BUNCH | BUNCH | 60 |
| BUNCH | BUNCH | BUNCH | | | 20 |
| | | BUNCH | BUNCH | BUNCH | 20 |
| BUNCH | BUNCH | | | | |
| | | | BUNCH | BUNCH | |
| COCO | COCO | COCO | COCO | COCO | 200 |
| COCO | COCO | COCO | COCO | | 50 |
| | COCO | COCO | COCO | COCO | 50 |
| COCO | COCO | COCO | | | 15 |
| | | COCO | COCO | COCO | 15 |
| CHER | | | | | 2 |
| KIWI | KIWI | KIWI | KIWI | KIWI | 150 |

TABLE A-1-continued

| WIN COMBINATION | | | | | |
|---|---|---|---|---|---|
| Reel 30 | Reel 32 | Reel 34 | Reel 36 | Reel 38 | PAY |
| KIWI | KIWI | KIWI | KIWI | | 40 |
| | KIWI | KIWI | KIWI | KIWI | 40 |
| KIWI | KIWI | KIWI | | | 12 |
| | | KIWI | KIWI | KIWI | 12 |
| ORAN | ORAN | ORAN | ORAN | ORAN | 100 |
| ORAN | ORAN | ORAN | ORAN | | 30 |
| | ORAN | ORAN | ORAN | ORAN | 30 |
| ORAN | ORAN | ORAN | | | 10 |
| | | ORAN | ORAN | ORAN | 10 |
| STRAW | STRAW | STRAW | STRAW | STRAW | 80 |
| STRAW | STRAW | STRAW | STRAW | | 20 |
| | STRAW | STRAW | STRAW | STRAW | 20 |
| STRAW | STRAW | STRAW | | | 7 |
| | | STRAW | STRAW | STRAW | 7 |
| WILD | | | | | 0 |
| | | | | WILD | 0 |
| BONUS PAYS | | | | | |
| HIPPO | HIPPO | HIPPO | HIPPO | HIPPO | 4 |
| HIPPO | HIPPO | HIPPO | HIPPO | | 4 |
| HIPPO | HIPPO | HIPPO | | | 4 |
| HIPPO | HIPPO | | | | 4 |
| | HIPPO | HIPPO | HIPPO | HIPPO | 4 |
| | | HIPPO | HIPPO | HIPPO | 4 |
| | | | HIPPO | HIPPO | 4 |
| TURTLE | TURTLE | TURTLE | TURTLE | TURTLE | 4 |
| TURTLE | TURTLE | TURTLE | TURTLE | | 4 |
| TURTLE | TURTLE | TURTLE | | | 4 |
| TURTLE | TURTLE | | | | 4 |
| | TURTLE | TURTLE | TURTLE | TURTLE | 4 |
| | | TURTLE | TURTLE | TURTLE | 4 |
| | | | TURTLE | TURTLE | 4 |
| GORILLA | GORILLA | GORILLA | GORILLA | GORILLA | 4 |
| GORILLA | GORILLA | GORILLA | GORILLA | | 4 |
| GORILLA | GORILLA | GORILLA | | | 4 |
| GORILLA | GORILLA | | | | 4 |
| | GORILLA | GORILLA | GORILLA | GORILLA | 4 |
| | | GORILLA | GORILLA | GORILLA | 4 |
| | | | GORILLA | GORILLA | 4 |

Table A-1 is a pay table identifying various winning combinations of symbols in the TOP BANANA™ basic game. The various symbols used in one embodiment of the TOP BANANA™ basic game include: "TOP BANANA," "SHELL," "SCALLOP," "STARFISH," "BUNCH," "COCONUT," "CHERRY," "KIWI," "ORANGE," "STRAWBERRY" and "WILD ISLAND."

The "WIN COMBINATIONS" column identifies the various win combinations which may occur by symbols stopping on an active payline. The win combinations of Table A-1 are presented in various categories, with headings (e.g., "TOP BANANA," "SHELL," etc.) corresponding to the particular symbols which make up the winning combinations. Listed underneath the respective headings are the specific type(s) and number(s) of combinations of symbols defining the various winning combinations. Generally, winning combinations require that at least two of five corresponding symbols be displayed, on an active payline, on the designated reels shown in the "WIN COMBINATIONS" column. For example, Table A-1 shows that there are seven winning combinations of "TOP BANANA" symbols that might occur in the TOP BANANA™ basic game, including: a combination of five consecutive "TOP BANANA" symbols (i.e., on reels 30 through 38); two combinations of four consecutive "TOP BANANA" symbols (i.e., on reels 30 through 36 and on reels 32 through 38); two combinations of three consecutive "TOP BANANA" symbols (i.e., on reels 30 through 34 and on reels 34 through 38) and two combinations of two consecutive "TOP BANANA" symbols (i.e., on reels 30 and 32 and on reels 36 and 38). The winning combinations of symbols other than "TOP BANANA" symbols are identified in similar fashion in Table A-1.

In one embodiment, the "BUNCH" symbols comprise both yellow and green banana bunch symbols, hereinafter designated "BUNCH (yellow)" and "BUNCH (green)," respectively. The green "BUNCH" symbols act as wildcards for yellow "BUNCH" symbols. Thus, for example, the combination of "BUNCH (yellow)," "BUNCH (green)" and "BUNCH (yellow)" symbols on adjacent reels 30 to 34 is equivalent to the combination of three "BUNCH (yellow)" symbols appearing on reels 30 to 34.

In one embodiment, the "WILD ISLAND" ("WILD") symbol acts as a wildcard for all symbols except "CHERRY" and "BUNCH (green)." Thus, for example, the combination of "WILD," "STARFISH" and "STARFISH" symbols on adjacent reels 30 to 34 is equivalent to the combination of three "STARFISH" symbols appearing on reels 30 to 34.

The "PAY" column of Table A-1 identifies the amount of coin(s) or credit(s) awarded for the various winning combinations in the basic game, per unit wagered. Thus, for example, the "TOP BANANA," "TOP BANANA" combination appearing on reels 30, 32 or 36, 38 will pay 10 coins or credits with one coin played; that same combination will pay 50 coins or credits with five coins played. The amount of coin(s) or credit(s) paid for any given combination traditionally corresponds inversely to the probability of "hitting" the combination, less an appropriate "hold percentage" retained by the gaming machine.

Figure 4A:
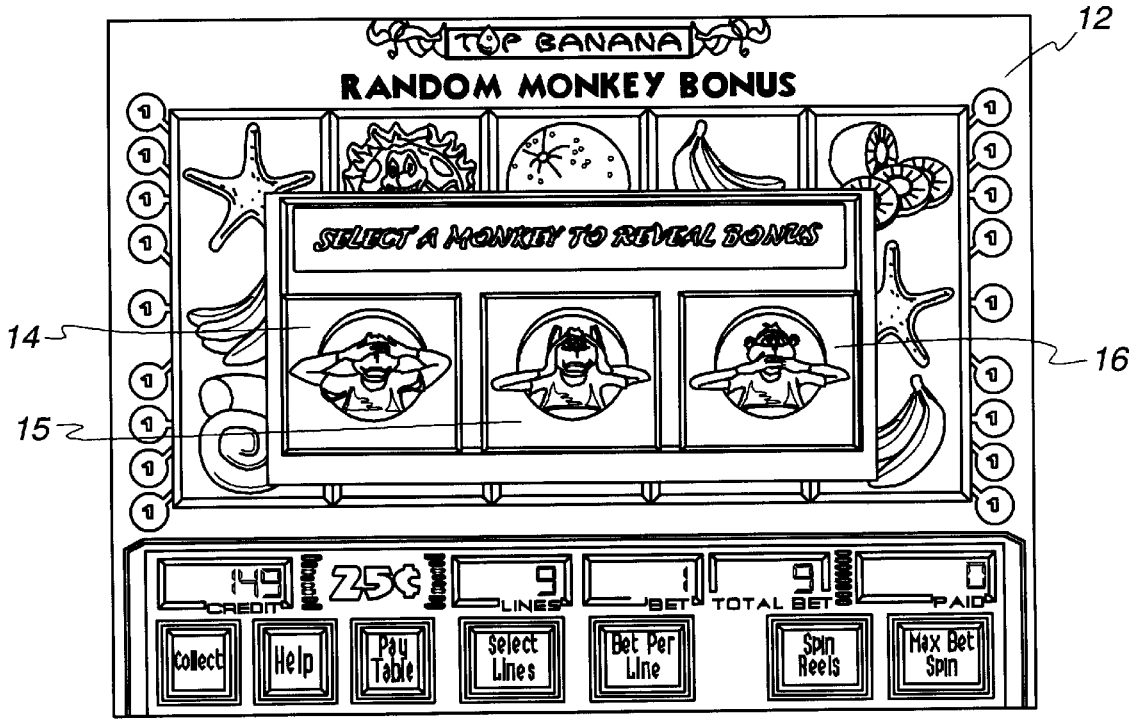
FIG. 4*a* illustrates a first display screen of an award selection feature which appears in one embodiment of the basic game of FIG. 3.
Figure 4B:
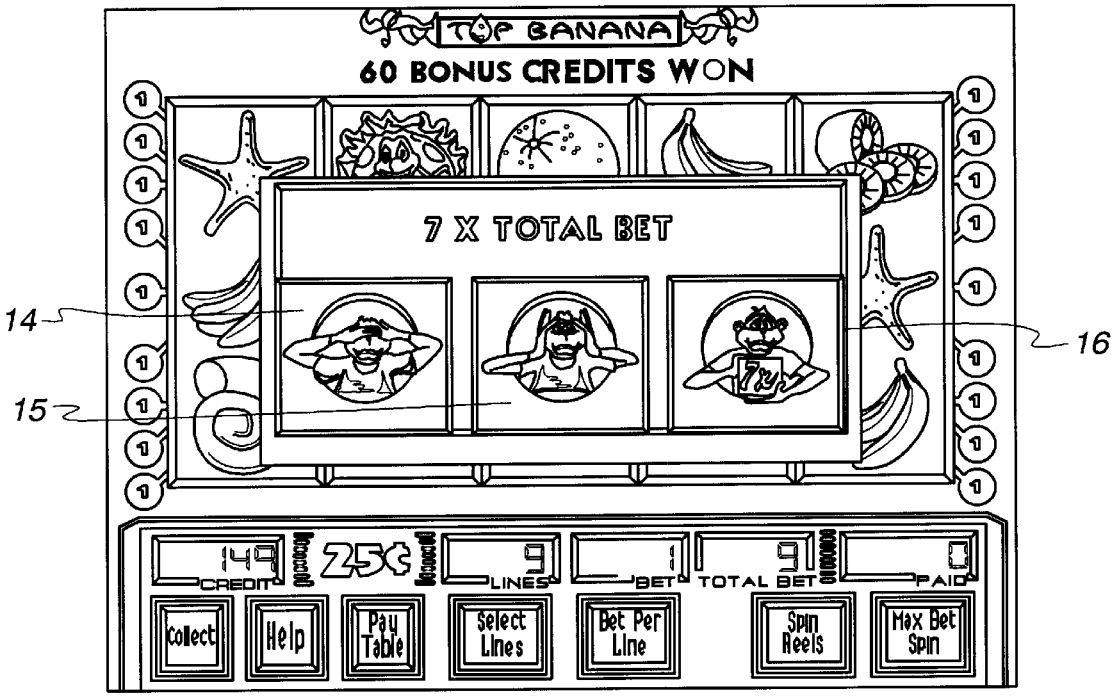
FIG. 4*b* shows a second display screen of the award selection feature of FIG. 4*a;*
Figure 4C:
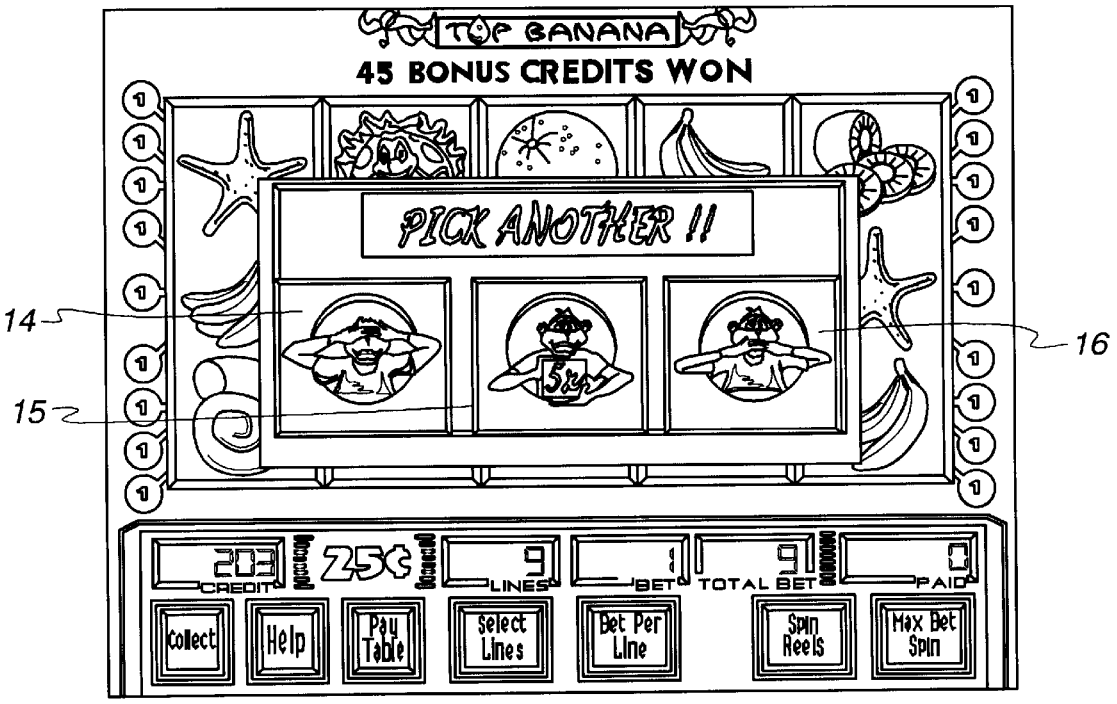
FIG. 4*c* shows a third display screen of the award selection feature of FIG. 4*a;*

In one embodiment, three "BUNCH (green)" symbols occurring in scatter-pay format is a winning combination which will pay an amount of coins or credits determined by an award selection feature termed a "Random Monkey Bonus." The term "scatter-pay" means that a winning combination occurs when the appropriate number of symbols are displayed, in any position, on any of the reels. In one embodiment of the TOP BANANA™ game, the occurrence of three "BUNCH (green)" symbols in scatter-pay format triggers the Random Monkey Bonus which causes the CPU 20 to display, on the video display 12, a selection screen of the type shown in FIG. 4*a*. The selection screen offers the player a choice between a plurality of selection elements each of which is associated with a hidden bonus. The hidden bonus may comprise, for example, fixed amounts or multiplier values. In the embodiment of FIGS. 4*a–c,* the selection elements are three animated monkeys 14, 15, 16 on the touch-screen display 12 and the hidden bonuses are multiplier amounts.

As shown in FIG. 4*a,* the player is prompted to "SELECT A MONKEY TO REVEAL BONUS." Thereafter, the player selects one of three monkeys ("selection elements") 14, 15, 16 by touching the touch-screen 12 over the desired selection element. The CPU 20 identifies the multiplier amount associated with the selected monkey and then operates to drive a display of the selected monkey with the hidden bonus revealed. FIG. 4*b,* for example, is a display which reveals a multiplier of "7×," associated with the selection of monkey 16. The "7×" multiplier causes the CPU 20 to award the player seven times the total bet. In most instances, the player is offered only one choice of selection element and the CPU 20 will return to the basic game after awarding the player the award associated with the player's selection. However, on random occasions one third of the time overall determined by the CPU 20, the CPU 20 will drive a display which prompts the player to "PICK ANOTHER!!" as best observed in FIG. 4*c,* in which case the player is awarded a second choice of selection element and thereby increase the possible award to as much as ten to thirty-five times the total bet.

Figure 5:
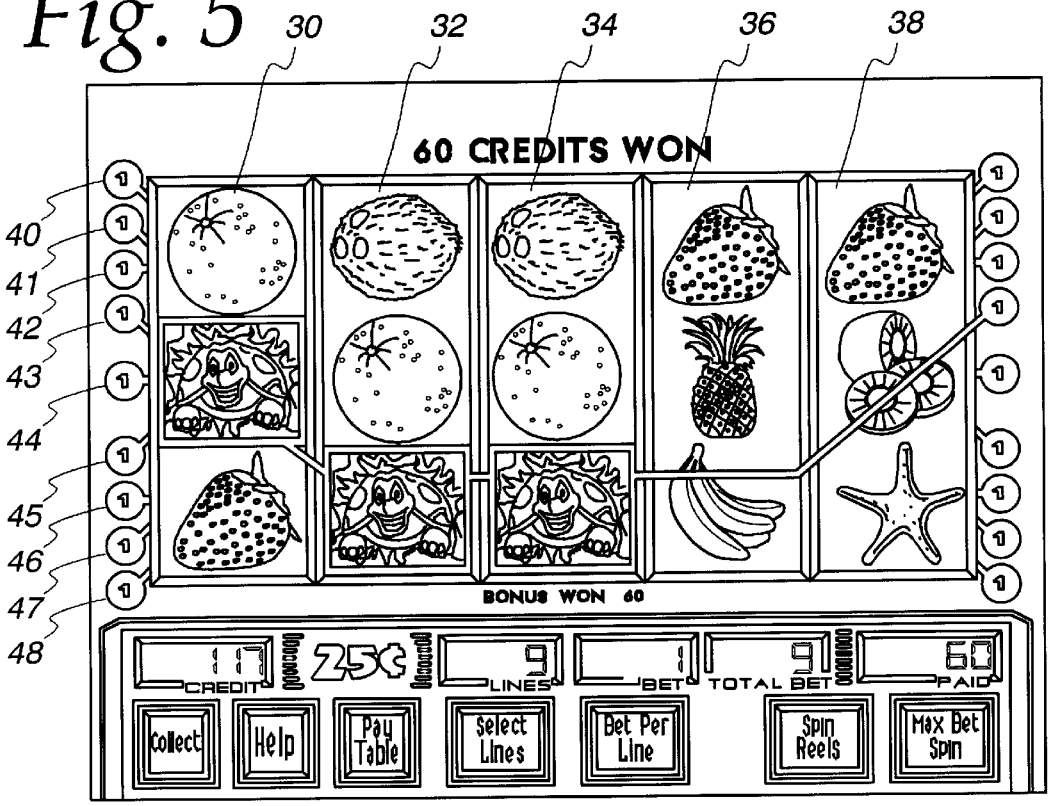
FIG. 5 shows an outcome of the basic game of FIG. 3 which will trigger a bonus game with strategy options according to one embodiment of the present invention.

The CPU 20 enters the bonus game when a special "start-bonus" outcome occurs on an active payline in the basic game. Generally, in the TOP BANANAS game, the start-bonus outcomes comprise three or more consecutive "HIPPO," consecutive "TURTLE" or consecutive "GORILLA" symbols displayed, on an active payline, on the designated reels shown in the "WIN COMBINATIONS" column of Table A-1. FIG. 5, for example, shows a combination of three consecutive "TURTLE" symbols on payline 43 of reels 30, 32 and 34 (30 through 34) which will trigger a bonus game (with payline 43 activated).

Specifically, in the embodiment of Table A-1, there are five combinations of "start-bonus" symbols ("HIPPO," "TURTLE" and "GORILLA") that might occur in the TOP BANANA basic game which will cause the CPU 20 to enter the bonus game. These symbol combinations include: a combination of five consecutive "HIPPO," five consecutive "TURTLE" or five consecutive "GORILLA" symbols (i.e., on reels 30 through 38); two combinations of four consecutive "HIPPO," four consecutive "TURTLE" or four consecutive "GORILLA" symbols (i.e., on reels 30 through 36 and on reels 32 through 38) and two combinations of three consecutive "HIPPO," three consecutive "TURTLE" or three consecutive "GORILLA" symbols (i.e., on reels 30 through 34 and on reels 34 through 38).

In one embodiment, the number(s) and type(s) of consecutive "HIPPO," "TURTLE" or "GORILLA" symbols in the start-bonus combination(s) which trigger the bonus game can influence the bonus game payoff. For example, whereas a single winning combination of three start-bonus symbols on an active payline will trigger the bonus round, the occurrence of more than one start-bonus combination or the occurrence of a start-bonus combination with greater than three bonus symbols will cause the CPU 20 to double or quadruple the payoff, as follows: (1) winning combinations of four or five start-bonus symbols on an active payline trigger the bonus round and will double all bonus round pays; (2) two winning combinations of three start-bonus symbols on an active payline trigger the bonus round and will double all bonus round pays; and (3) two winning combinations of four or five start-bonus symbols on an active payline trigger the bonus round and will multiply all bonus round pays by four.

In one embodiment, the "WILD ISLAND" ("WILD") symbol acts as a wildcard for any of the consecutive "HIPPO," "TURTLE" or "GORILLA" start-bonus combinations described above. Thus, for example, the combination of "WILD," "HIPPO" and "HIPPO" symbols on adjacent reels 30 to 34 is equivalent to the combination of three consecutive "HIPPO" symbols appearing on reels 30 to 34.

In Table A-1, the values of the respective start-bonus combinations in the "PAY" column is four coins or credits for each combination. It will be appreciated that the basic game payoff associated with the respective start-bonus combinations might comprise any of several alternative values, including zero value in the basic game. It will further be appreciated that Table A-1 identifies a basic game payoff associated with the respective combinations and, generally, a greater value may be derived from the respective consecutive "HIPPO," "TURTLE" or "GORILLA" start-bonus combinations in the bonus game.

Figure 6A:
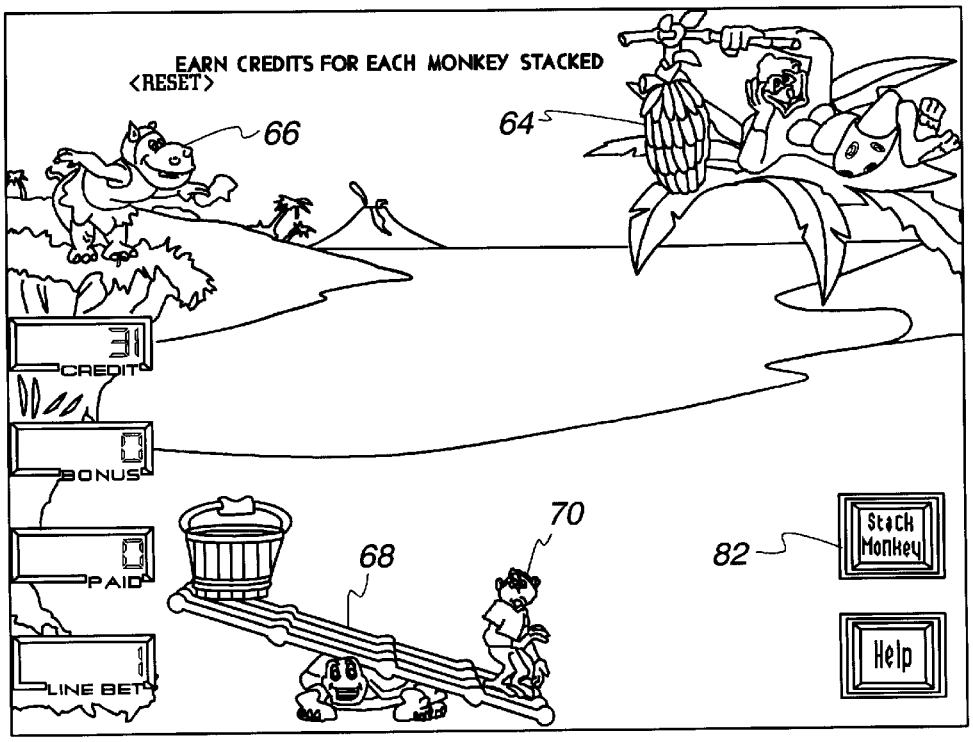
FIG. 6*a* illustrates a first display screen of a bonus game with strategy options according to one embodiment of the present invention.
Figure 6B:
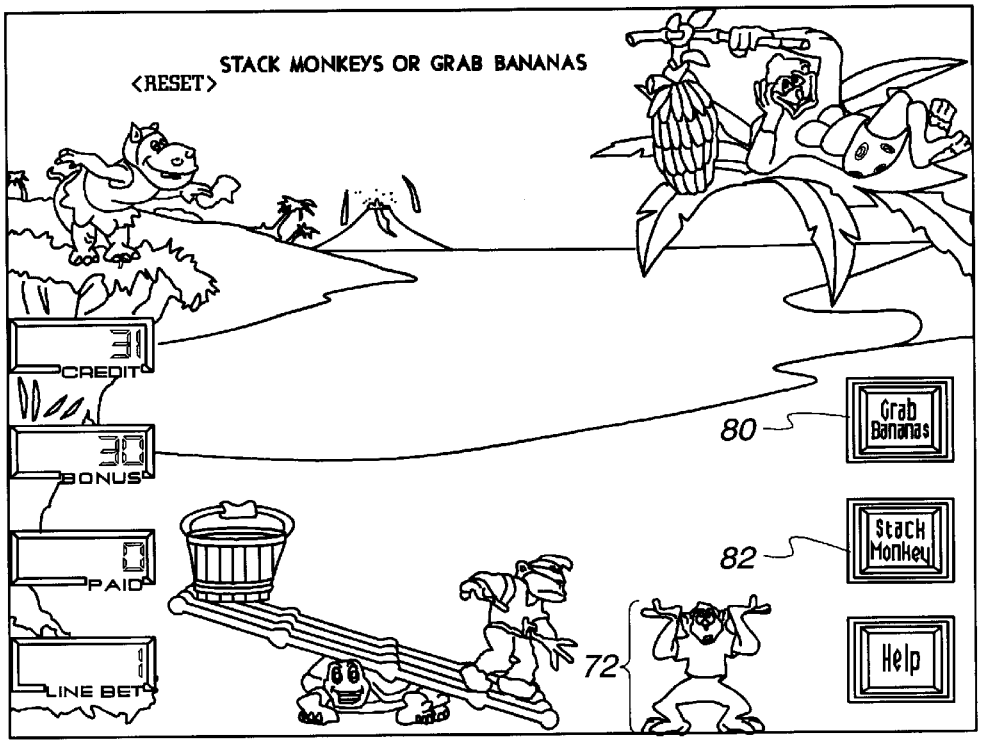
FIG. 6*b* shows a second display screen of the bonus game of FIG. 6*a;*

Upon entering the bonus game, the CPU 20 operates to replace the display of reels 30, 32, 34, 36, 38 on video display 12 with a bonus game screen depicting a first stage of the bonus game. FIG. 6*a* is an illustration of a bonus game screen depicting a first stage of the TOP BANANAS bonus game. Generally, the bonus game provides for the player to choose, one at a time, a sequence of game strategy options, each of which is associated with a game activity or "action" having an outcome which affects the bonus game play. The term strategy option refers to a selection choice presented to the player and does not infer that the player may learn the best outcome. In one embodiment, the game strategy options, game activities and the possible outcomes of those strategy options/activities are defined by a game program stored in the system memory 24 and executable by the CPU 20. After selection of each respective strategy option, the CPU 20 identifies the game activity associated with the selected strategy option and then "performs" the game activity by selecting an outcome and causing the display 12 to display indicia of the selected outcome. In one embodiment, certain of the game activities have outcomes which are determined randomly by the CPU 20 according to a selection probability defined by the game program, and certain other activities have predetermined outcomes, depending on the selected strategy option and the game program. It will be appreciated that the game activities might have outcomes comprising any combination of randomly determined outcomes and predetermined outcomes, depending on the game program.

Generally, the course of the bonus game, and consequently the amount of coins or credits which are to be awarded to the player, is determined by the sequence of strategy option(s) selected by the player and the performance of game activities associated with the selected strategy options. The strategy options available to the player, game activities associated with the respective strategy options and the outcomes of those activities may differ, according to the game program, at different stages of the bonus game. The probability of certain outcomes occurring may also differ, according to the game program, at different stages of the bonus game. In one embodiment, the player is offered game strategy options or "actions" at each stage and the associated game activities are performed, one at a time, until an outcome of one of the activities ends the bonus game.

In the TOP BANANA™ bonus game, for example, the course of the bonus game is generally determined by the player selecting between two strategy options: "Stack Monkeys" or "Grab Bananas." Each strategy option is associated with a game activity or action which, in the TOP BANANA™ M game, is logically associated with the name of the strategy option. Specifically, in the TOP BANANA™ game, the "Stack Monkeys" option is logically associated with a "Stack Monkeys" action which, as the name implies, involves the player attempting to "stack" monkeys on top of each other. Similarly, the "Grab Bananas" option is logically associated with a "Grab Bananas" action which involves the player attempting to have the monkeys grab bananas which are hanging from a tree. Each of these actions will be described in relation to FIGS. 6*a*–6*c*.

Generally, the exercise ("performance") of either a "Stack Monkeys" action or a "Grab Bananas" action may result in either of two possible outcomes: "Success" or "Failure." A "Success" outcome defines a successful exercise of the action and a "Failure" outcome defines a failed exercise of the action. As heretofore described, the likelihood of success or failure of the exercise generally differs according to the particular strategy option ("action") which is being exercised and the stage of the bonus game in which it is exercised. In one embodiment, when the player enters a first stage of the bonus game, as shown in FIG. 6*a,* the player has only one option— "Stack Monkeys," which is exercised by the player touching the "Stack Monkey" key 82 on the video display 12. The CPU 20 then selects an outcome of the "Stack Monkeys" action which in one embodiment is always successful in the first stage. Next, in one embodiment, the CPU 20 causes the video display 12 to show indicia of the action being performed and the outcome of the action. Specifically, in one embodiment of the TOP BANANA™ game, the displayed indicia of a first successful "Stack Monkey" action comprises an animated hippo character 66 jumping on a see-saw 68, which in turn causes an animated monkey character 70 on the other end of the see-saw 68 to be launched into the air and then to occupy a first position 72 (FIG. 6*b*) underneath a bunch of bananas 64. If the "Stack Monkeys" action is unsuccessful, the video display 12 will show the animated monkey character 70 falling or otherwise not successfully landing in the first position 72.

Figure 6C:
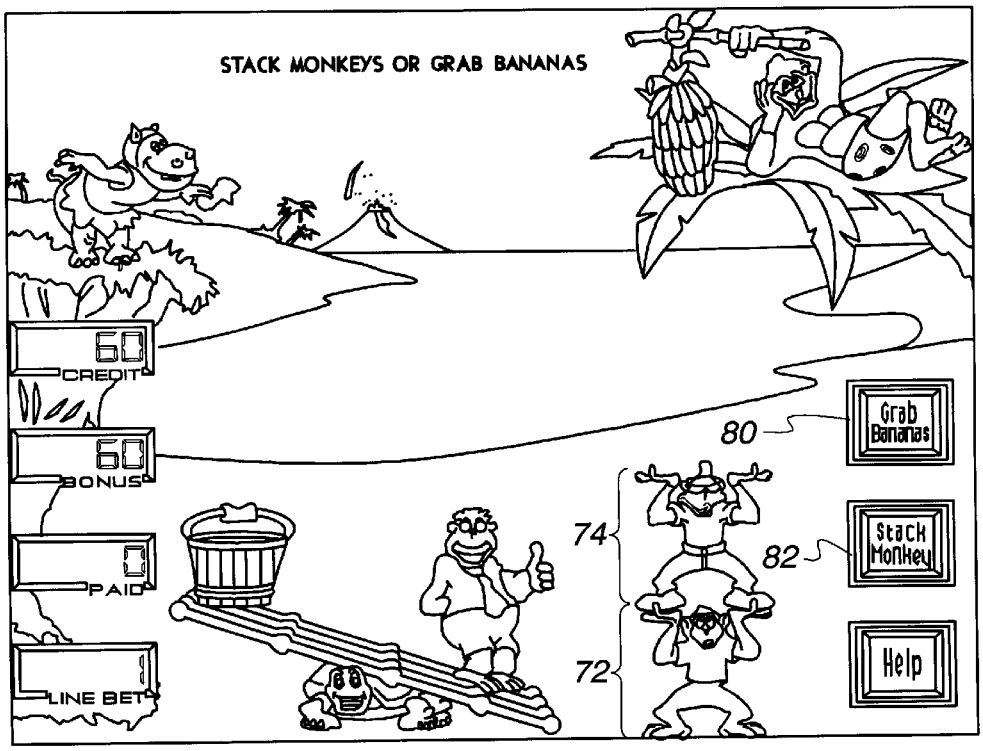
FIG. 6*c* shows a third display screen of the bonus game of FIG. 6*a;*
Figure 6D:
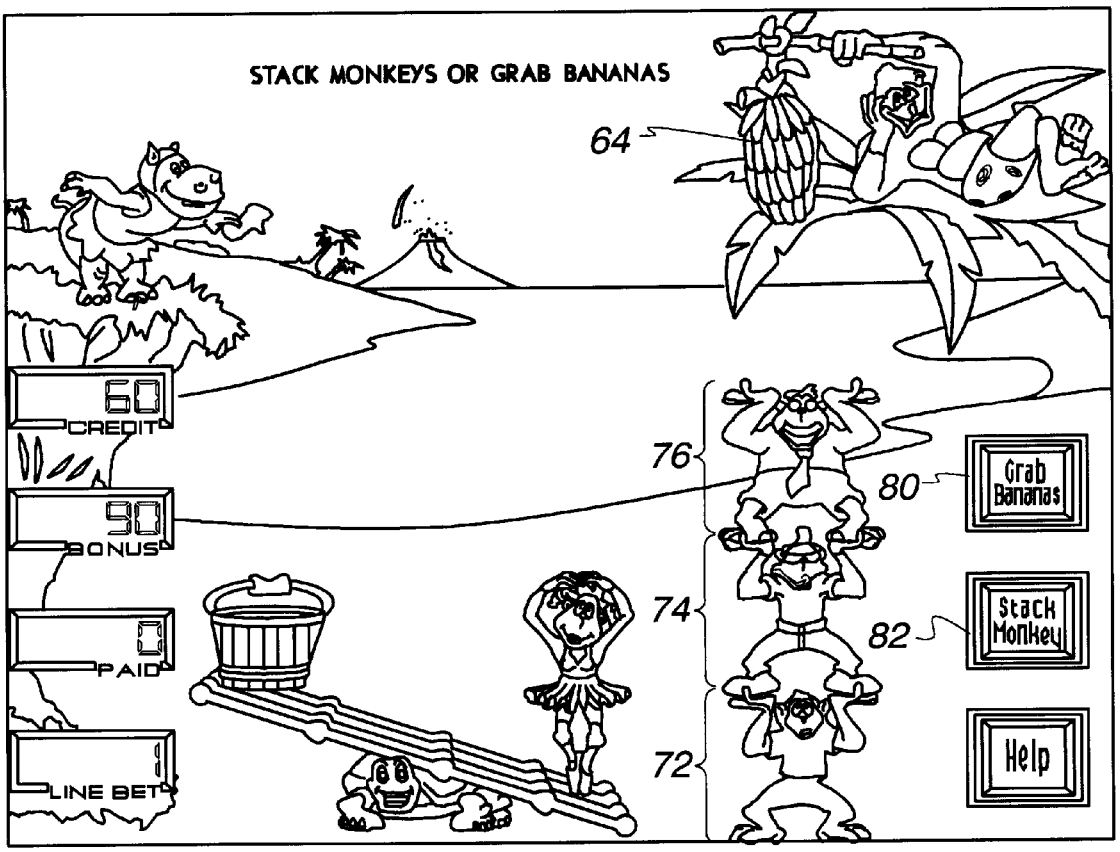
FIG. 6*d* shows a fourth display screen of the bonus game of FIG. 6*a;*

In one embodiment, successful "Stack Monkeys" actions in further stages of the bonus game will cause up to three additional monkey characters 70 to become similarly launched and to occupy respective second, third, and fourth positions underneath the bunch of bananas 64. For example, FIG. 6*c* illustrates a stage of the bonus game after two successful "Stack Monkeys" options, with respective monkey characters displayed in the first position 72 and a second position 74 underneath the stack of bananas 64. FIG. 6*d* illustrates a stage of the bonus game after three successful "Stack Monkeys" options, with respective monkey characters displayed in the first position 72, second position 74 and third position 76 underneath the stack of bananas 64.

In one embodiment, the game program may define a progressively lower, or higher, selection probability for a particular outcome as the game progresses between the various stages. Specifically, in one embodiment, the game program defines a progressively lower selection probability of the "Success" outcome of the "Stack Monkeys" option as the game progresses, as follows: 100% likelihood of success for the first exercise, an 80% likelihood of success for the second exercise, a 65% likelihood of success for the third exercise and a 60% likelihood of success for the fourth exercise.

For each successful "Stack Monkeys" action, the player is awarded an amount of coins or credits and the bonus game continues to successive stages, each stage generally offering the player a choice between the "Stack Monkeys" or "Grab Bananas" action. If the bonus game enters a stage in which four monkeys are stacked, the player is given only the "Grab Bananas" option. In one embodiment, if there is a failed "Stack Monkeys" action, the bonus game ends and no additional credits are awarded although the player keeps the amount of coins or credits previously accumulated in the bonus game.

In one embodiment, the player may exercise the "Grab Bananas" option at any time when the bonus game includes one, two, three or four stacked monkeys. An exercise of the "Grab Bananas" option causes the video display 12 to show the top "stacked" monkey jumping up in an attempt to grab the banana bunch 64. A successful "Grab Bananas" option will result in the monkey successfully grabbing the bananas, and will cause the player to be awarded an amount of coins or credits defined by the game program.

In one embodiment, the award associated with grabbing the bananas defines a target credit value or target award which is randomly determined by the CPU 20 according to a weighted table. Specifically, in one embodiment, there are seven possible awards associated with grabbing the bananas: 100, 150, 200, 250, 300, 400 or 500 coins or credits. A weighted table associated with the "Grab Bananas" option defines a set of eighteen possible occurrences of the various awards: 1 occurrence associated with an award of 100 coins, 3 occurrences associated with an award of 150 coins, 4 occurrences associated with an award of 200 coins, 4 occurrences associated with an award of 250 coins, 3 occurrences associated with an award of 300 coins, 2 occurrences associated with an award of 400 coins and 1 occurrence associated with an award of 500 coins. In one embodiment, the CPU 20 selects the target award from the award table by selecting a random number from one to eighteen, then stepping through each occurrence until it finds the award corresponding to that random number. Thus, continuing the above example, a random number of 5 might indicate that the CPU 20 would select a target award of 200 coins, since the first "step through" is 100 coins, the next three "step throughs" are 150 coins and the next step ends on an award of 200 coins.

In one embodiment, the game program defines a progressively higher selection probability of the "Success" outcome of the "Grab Bananas" option as the game progresses, as follows: 20% likelihood of successfully grabbing the bananas with one stacked monkey, a 30% likelihood of success with two stacked monkeys, a 40% likelihood of success with three stacked monkeys and a 60% likelihood of success with four stacked monkeys. In one embodiment, if there is a failed "Grab Bananas" action, the bonus game continues although no additional credits are awarded. In one embodiment, a failed "Grab Bananas" action causes a penalty to be incurred which decreases the amount of the target credit value which is available for a later, successful "Grab Bananas" action. The penalty is animated by the gorilla eating a portion of the bananas 64. The penalty amount(s), and the stages in which the penalty may be incurred are defined in the bonus game program. For example, in one embodiment, the game program might define an initial target value of 100 credits and a penalty amount of 50 credits which might be incurred upon a first failed exercise of the "Grab Bananas" action, thus reducing the target credit value to 50 credits. In one embodiment, the game program also defines a minimum target value which, once obtained, may not be reduced by further failed "Grab Bananas" action(s). Thus, for example, if the minimum target value is 50 credits, and the target value is reduced to 50 credits after a first failed exercise of the "Grab Bananas" action, there would be no additional penalty for later failed "Grab Bananas" actions.

In one embodiment, the "Grab Bananas" action, if unsuccessful, may be repeated a number of times with the same number of stacked monkeys, with generally the same probability of success, until one of the attempts is successful and/or until an upper limit of attempts is reached. In one embodiment, for example, the game program defines an upper limit to the number of attempts at any level (e.g., four) and defines a 100% probability of success for the fourth attempt, whereas each of the other attempts has a lower probability corresponding to the number of stacked monkeys. For example, in one embodiment, the "Grab Bananas" action has a 21% likelihood of success with one stacked monkey in each of the first, second and third attempts and a 100% probability of success for the fourth attempt. Alternatively, the game program might define different probabilities of success for each successive attempt. Moreover, if the game program defines less than a 100% probability of success for the final attempt, and if such attempt is unsuccessful, another game program alternative might cause the bonus game to be ended after such final, failed attempt or require the player to exercise a "Stack Monkeys" action to increase the number of stacked monkeys and thereby increase the chance for a later, successful "Grab Bananas" action.

TABLE A-2

| # Monkeys Stacked | Stack Pay | Total Stack Pay | Stack Chance | Overall Stack Chance | Banana Chance | Overall Grab Chance | Banana Award | Total Pay |
|---|---|---|---|---|---|---|---|---|
| | | | Multiple Banana Chances with 100 Banana Pay | | | | | |
| 1 | 30 | 30 | 1.00 | 1.00 | 0.21 | 0.51 | 100 | 130 |
| 2 | 30 | 60 | 0.80 | 0.80 | 0.30 | 0.53 | 100 | 160 |
| 3 | 30 | 90 | 0.65 | 0.52 | 0.40 | 0.41 | 100 | 190 |
| 4 | 30 | 120 | 0.60 | 0.31 | 0.60 | 0.29 | 100 | 220 |
| | | | Multiple Banana Chances with 150 Banana Pay | | | | | |
| 1 | 30 | 30 | 1.00 | 1.00 | 0.21 | 0.51 | 150 | 180 |
| 2 | 30 | 60 | 0.80 | 0.80 | 0.30 | 0.53 | 150 | 210 |
| 3 | 30 | 90 | 0.65 | 0.52 | 0.40 | 0.41 | 150 | 240 |
| 4 | 30 | 120 | 0.60 | 0.31 | 0.60 | 0.29 | 150 | 270 |
| | | | Multiple Banana Chances with 200 Banana Pay | | | | | |
| 1 | 30 | 30 | 1.00 | 1.00 | 0.21 | 0.51 | 200 | 230 |
| 2 | 30 | 60 | 0.80 | 0.80 | 0.25 | 0.46 | 200 | 260 |
| 3 | 30 | 90 | 0.65 | 0.52 | 0.40 | 0.41 | 200 | 290 |
| 4 | 30 | 120 | 0.60 | 0.31 | 0.60 | 0.29 | 200 | 320 |
| | | | Multiple Banana Chances with 250 Banana Pay | | | | | |
| 1 | 30 | 30 | 1.00 | 1.00 | 0.20 | 0.49 | 250 | 280 |
| 2 | 30 | 60 | 0.80 | 0.80 | 0.25 | 0.46 | 250 | 310 |
| 3 | 30 | 90 | 0.65 | 0.52 | 0.40 | 0.41 | 250 | 340 |
| 4 | 30 | 120 | 0.60 | 0.31 | 0.65 | 0.30 | 250 | 370 |
| | | | Multiple Banana Chances with 300 Banana Pay | | | | | |
| 1 | 30 | 30 | 1.00 | 1.00 | 0.20 | 0.49 | 300 | 330 |
| 2 | 30 | 60 | 0.80 | 0.80 | 0.25 | 0.46 | 300 | 360 |

TABLE A-2-continued

| # Monkeys Stacked | Stack Pay | Total Stack Pay | Stack Chance | Overall Stack Chance | Banana Chance | Overall Grab Chance | Banana Award | Total Pay |
|---|---|---|---|---|---|---|---|---|
| 3 | 30 | 90 | 0.65 | 0.52 | 0.40 | 0.41 | 300 | 390 |
| 4 | 30 | 120 | 0.60 | 0.31 | 0.65 | 0.30 | 300 | 420 |
| | | | Multiple Banana Chances with 400 Banana Pay | | | | | |
| 1 | 30 | 30 | 1.00 | 1.00 | 0.20 | 0.49 | 400 | 430 |
| 2 | 30 | 60 | 0.80 | 0.80 | 0.25 | 0.46 | 400 | 460 |
| 3 | 30 | 90 | 0.65 | 0.52 | 0.40 | 0.41 | 400 | 490 |
| 4 | 30 | 120 | 0.60 | 0.31 | 0.65 | 0.30 | 400 | 520 |
| | | | Multiple Banana Chances with 500 Banana Pay | | | | | |
| 1 | 30 | 30 | 1.00 | 1.00 | 0.15 | 0.39 | 500 | 530 |
| 2 | 30 | 60 | 0.80 | 0.80 | 0.22 | 0.42 | 500 | 560 |
| 3 | 30 | 90 | 0.65 | 0.52 | 0.40 | 0.41 | 500 | 590 |
| 4 | 30 | 120 | 0.60 | 0.31 | 0.65 | 0.30 | 400 | 620 |
| | | | Multiple Banana Chances with 200 Banana Pay | | | | | |
| 1 | 60 | 60 | 1.00 | 1.00 | 0.21 | 0.51 | 200 | 260 |
| 2 | 60 | 120 | 0.80 | 0.80 | 0.30 | 0.53 | 200 | 320 |
| 3 | 60 | 180 | 0.65 | 0.52 | 0.40 | 0.41 | 200 | 380 |
| 4 | 60 | 240 | 0.60 | 0.31 | 0.60 | 0.29 | 200 | 440 |
| | | | Multiple Banana Chances with 300 Banana Pay | | | | | |
| 1 | 60 | 60 | 1.00 | 1.00 | 0.21 | 0.51 | 300 | 360 |
| 2 | 60 | 120 | 0.80 | 0.80 | 0.30 | 0.53 | 300 | 420 |
| 3 | 60 | 180 | 0.65 | 0.52 | 0.40 | 0.41 | 300 | 480 |
| 4 | 60 | 240 | 0.60 | 0.31 | 0.60 | 0.29 | 300 | 540 |
| | | | Multiple Banana Chances with 400 Banana Pay | | | | | |
| 1 | 60 | 60 | 1.00 | 1.00 | 0.21 | 0.51 | 400 | 460 |
| 2 | 60 | 120 | 0.80 | 0.80 | 0.25 | 0.46 | 400 | 520 |
| 3 | 60 | 180 | 0.65 | 0.52 | 0.40 | 0.41 | 400 | 580 |
| 4 | 60 | 240 | 0.60 | 0.31 | 0.60 | 0.29 | 400 | 640 |
| | | | Multiple Banana Chances with 500 Banana Pay | | | | | |
| 1 | 60 | 60 | 1.00 | 1.00 | 0.20 | 0.49 | 500 | 560 |
| 2 | 60 | 120 | 0.80 | 0.80 | 0.25 | 0.46 | 500 | 620 |
| 3 | 60 | 180 | 0.65 | 0.52 | 0.40 | 0.41 | 500 | 680 |
| 4 | 60 | 240 | 0.60 | 0.31 | 0.65 | 0.30 | 500 | 740 |
| | | | Multiple Banana Chances with 600 Banana Pay | | | | | |
| 1 | 60 | 60 | 1.00 | 1.00 | 0.20 | 0.49 | 600 | 660 |
| 2 | 60 | 120 | 0.80 | 0.80 | 0.25 | 0.46 | 600 | 720 |
| 3 | 60 | 180 | 0.65 | 0.52 | 0.40 | 0.41 | 600 | 780 |
| 4 | 60 | 240 | 0.60 | 0.31 | 0.65 | 0.30 | 600 | 840 |
| | | | Multiple Banana Chances with 800 Banana Pay | | | | | |
| 1 | 60 | 60 | 1.00 | 1.00 | 0.20 | 0.49 | 800 | 860 |
| 2 | 60 | 120 | 0.80 | 0.80 | 0.25 | 0.46 | 800 | 920 |
| 3 | 60 | 180 | 0.65 | 0.52 | 0.40 | 0.41 | 800 | 980 |
| 4 | 60 | 240 | 0.60 | 0.31 | 0.65 | 0.30 | 800 | 1040 |
| | | | Multiple Banana Chances with 1000 Banana Pay | | | | | |
| 1 | 60 | 60 | 1.00 | 1.00 | 0.15 | 0.39 | 1000 | 1060 |
| 2 | 60 | 120 | 0.80 | 0.80 | 0.22 | 0.42 | 1000 | 1120 |
| 3 | 60 | 180 | 0.65 | 0.52 | 0.40 | 0.41 | 1000 | 1180 |
| 4 | 60 | 240 | 0.60 | 0.31 | 0.65 | 0.30 | 1000 | 1240 |

Table A-2 is a pay table identifying various probabilities and awards associated with the strategy options in the TOP BANANA™ bonus game. The pay table is divided into various sections corresponding to the amount of the "Grab Bananas" award. For example, the section labeled "Multiple Banana Chance with 100 Banana Pay" identifies the probabilities, awards and expected values associated with the strategy options in the TOP BANANA™ bonus game, in the event the CPU 20 has selected 100 coins as the amount of the "Grab Bananas" award.

The entries in the left hand columns ("Monkey") of Table A-2 are numbered consecutively from 1 to 4 and correspond to the various possible numbers of successfully stacked monkeys. Monkey 1, for example, corresponds to one successfully stacked monkey, and so on until reaching Monkey 4, which corresponds to 4 successfully stacked monkeys.

The first "Stack Pay" column in each section of Table A-2 identifies the value of the respective stacked monkeys in the TOP BANANA™ bonus game, per unit wagered. Thus, for example, in a bonus game with a "Grab Bananas" award of 100 bananas, each stacked monkey is associated with an award of thirty coins or credits, with one coin played. Each stacked monkey will pay 150 coins or credits with five coins played.

The "Total Stack Pay" column in each section of Table A-2 identifies the cumulative amount of coin(s) or credit(s) which would be awarded by successfully stacking various numbers of monkeys. Thus, where each stacked monkey has a value of thirty coins or credits, two stacked monkeys have a cumulative value of sixty coins or credits, three stacked monkeys have a cumulative value of ninety coins or credits and four stacked monkeys have a cumulative value of one hundred twenty coins or credits, with one coin played.

The "Stack Chance" column identifies the a priori probability of success for each individual exercise of the "Stack Monkeys" option. For example, where the "Stack Chance" column has respective values of 1.00 for one monkey, 0.80 for two monkeys, 0.65 for three monkeys and 0.60 for four monkeys, this indicates that the first exercise of the "Stack Monkeys" option is always successful, the second exercise is 80% likely to succeed, the third exercise is 65% likely to succeed and the fourth exercise is 60% likely to succeed.

The "Overall Stack Chance" column identifies the probability of reaching, and successfully executing a "Stack Monkeys" option with various numbers of stacked monkeys. The "Overall Stack Chance" value for any particular number of monkeys is computed by multiplying the probability of reaching that number of monkeys (e.g., the probability that the preceding "Stack Monkey" exercises will not have failed) by the probability that that particular choice, once reached, will be successful. Consider, for example, a bonus game with a "Grab Bananas" award of 100 bananas. The "Overall Stack Chance" is 1.00 (100%) for the first monkey (Monkey 1) because the "Stack Monkeys" option is always successful the first time. For the second exercise, the "Overall Stack Chance" is 0.80 (80%) because there is no chance that the preceding "Stack Monkey" exercise could have failed, and because the second exercise, in itself, has an 80% success rate. For the third exercise, there is a 80% chance that the preceding "Stack Monkey" exercise will not have failed, and the third exercise, in itself, has an 65% success rate, so the "Overall Stack Chance" for the third monkey is 0.52 (0.80×0.65). For the fourth exercise, there is a 52% chance that the preceding "Stack Monkey" exercise will not have failed, and the. fourth exercise, in itself, has a 60% success rate, so the "Overall Stack Chance" for the fourth monkey is 0.312 (0.52×0.6).

The "Banana Chance" column identifies the a priori probability of successfully executing the "Grab Bananas" option in a first, second or third attempt with the respective numbers of stacked monkeys. For example, where the "Banana Chance" column has respective values of 0.21 for one monkey, 0.30 for two monkeys, 0.40 for three monkeys and 0.60 for four monkeys, this indicates that the "Grab Bananas" option, in itself, is 21% likely to succeed with one stacked monkey, 30% likely to succeed with two stacked monkeys, 40% likely to succeed with three stacked monkeys and 60% likely to succeed with four stacked monkeys in each of the first, second or third attempts.

The "Overall Grab Chance" column identifies the probability of successfully executing a "Grab Bananas" option in one of the first, second or third attempts after having successfully stacked the various numbers of monkeys. The "Overall Grab Chance" value for any particular number of monkeys is computed by multiplying the "Overall Stack Chance" value (e.g., the probability of reaching, and successfully executing the "Stack Monkeys" option(s)) by the probability that the "Grab Bananas" option will not have been unsuccessful on all three attempts. This latter value is computed by the formula $[1-(1-\text{Banana Chance})^3]$. In a game with 100 banana pay, such value is 0.506 for one stacked monkey (i.e., $1-(1-0.21)^3$), 0.657 for two stacked monkeys (i.e., $1-(1-0.3)^3$), 0.784 for three stacked monkeys (i.e., $1-(1-0.4)^3$) and 0.936 for four stacked monkeys (i.e., $1-(1-0.6)^3$). Thus, in a game with 100 banana pay, the "Overall Grab Chance" value for one monkey is 0.506 (i.e., 1×0.506), the "Overall Grab Chance" value for two monkeys is 0.526 (i.e., 0.8×0.657), the "Overall Grab Chance" value for three monkeys is 0.408 (i.e., 0.52×0.784) and the "Overall Grab Chance" value for four monkeys is 0.29 (i.e., 0.31×0.936).

The "Banana Award" column in each section of Table A-2 identifies the value of successfully exercising the "Grab Bananas" option. In the embodiment of Table A-2, the Banana Award does not vary when successfully executed with different numbers of stacked monkeys. Thus, for example, in a bonus game with a "Grab Bananas" award of 100 bananas, the award is 100 coins or credits, per unit wagered, whether executed with one, two, three or four stacked monkeys.

The "Total Pay" column identifies the cumulative amount of coin(s) or credit(s) which would be awarded by successfully executing the "Grab Bananas" option after stacking various numbers of monkeys. The "Total Pay" value for any particular number of monkeys is computed by summing the cumulative "Stack Monkeys" value (i.e., the second "Stack Pay" value) and the Banana Award.

Figure 7:
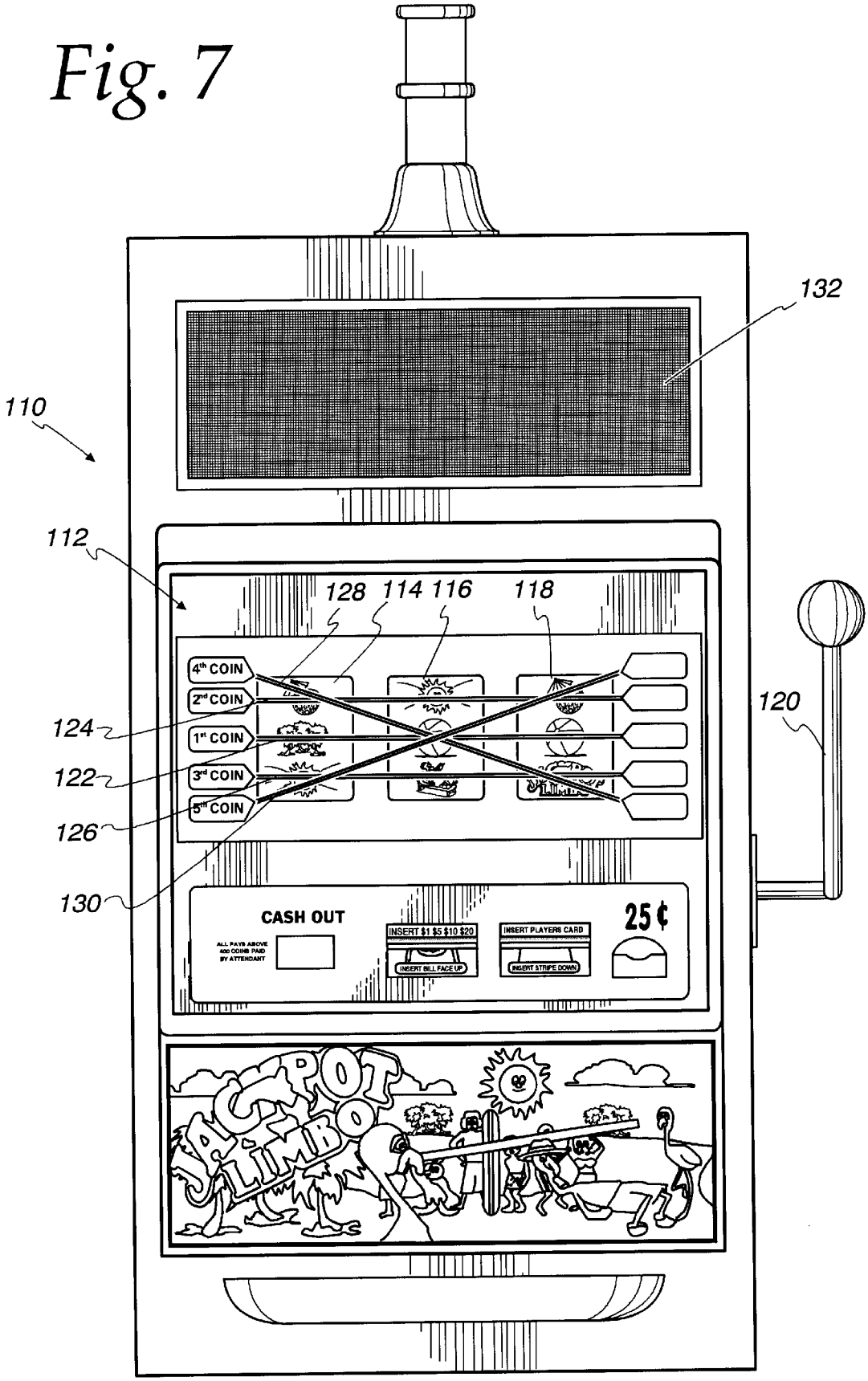
FIG. 7 is a simplified illustration of a gaming machine with dot matrix display operable to implement a bonus game with strategy options according to another embodiment of the present invention.

Now turning to FIG. 7, there is depicted a gaming machine 110 which may be used to implement a bonus game with strategy options according to another embodiment of the present invention. The gaming machine 110 includes three mechanical reels, 114, 116 and 118 and a graphics display 132 vertically disposed within an upper portion of the slot machine 110. The graphics display 132 may comprise a dot matrix, CRT, LED, LCD, electro-luminescent display or generally any type of video display known in the art. In the illustrated embodiment, the basic game is implemented on the reels 114, 116, 118 and the bonus game is implemented on the graphics display 132. Alternatively, both the basic and bonus games may be implemented on the graphics display 132 or on separate video display(s).

In one embodiment, the gaming machine 110 is operable to play a game entitled JACKPOT LIMBO™ which has a limbo party theme. The JACKPOT LIMBO™ game features a basic game implemented on the mechanical reels, 114, 116 and 118 and a bonus game with strategy options directing game activities on the graphics display 132. Nevertheless, it will be appreciated that the gaming machine 110 may be implemented with games other than the JACKPOT LIMBO™ game and/or with any of several alternative game themes.

Figure 8:
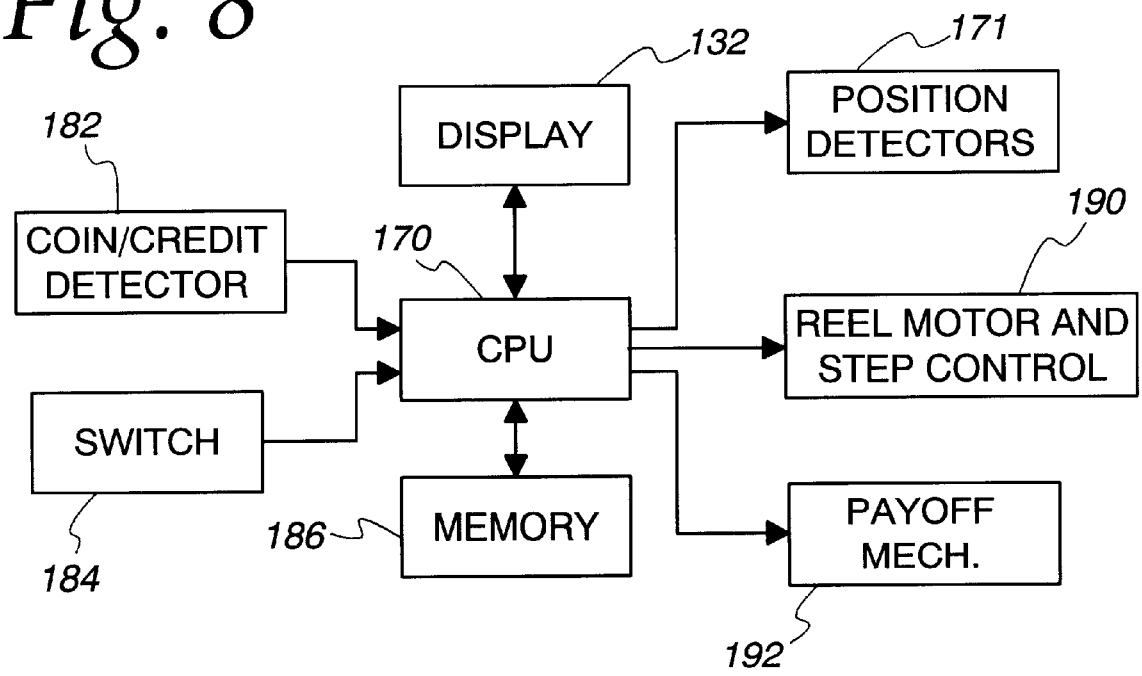
FIG. 8 is a block diagram of the gaming machine of FIG. 7.

FIG. 8 is a block diagram of a control system suitable for operating the gaming machine 110. Coin/credit detector 182 signals a CPU 170 when a player has inserted a number of coins or played a number of credits. Then, in response to the player activating a switch 184 (e.g., by pulling lever 120 (FIG. 7) or pushing a button (not shown)), the CPU 170 sets the reels 114, 116, 118 in motion and randomly selects a game outcome (e.g., "basic" game outcome). Using technology well known in the art, a reel motor and step controller 190 causes each of the reels 114, 116, 118 to stop at the preselected stop position. Symbols (see FIG. 9) are affixed to the reels 114, 116, 118 to graphically illustrate the reel stop position corresponding to the basic game outcome. In one embodiment, certain of the basic game outcomes cause the CPU 170 to enter a bonus mode causing the graphics display 132 to show a bonus game. The display screens associated with the JACKPOT LIMBO™ bonus game will be described in detail in relation to FIGS. 10 and 11.

A system memory 186 stores control software, operational instructions and data associated with the gaming machine 110. In one embodiment, the memory 186 comprises a separate read-only memory (ROM) and battery-backed random-access memory (RAM). However, it will be appreciated that the memory 186 may be implemented on any of several alternative types of memory structures or may be implemented on a single memory structure. A payoff mechanism 192 is operable in response to instructions from the CPU 170 to award a payoff of coins or credits to the player in response to certain winning outcomes which might occur in the basic game or bonus game. The payoff amounts corresponding to certain combinations of symbols in the basic game is predetermined according to a pay table stored in system memory 186. The payoff amounts corresponding to certain outcomes of the bonus game are also stored in system memory 186.

In the embodiment of FIG. 7, the JACKPOT LIMBO™ basic game is implemented on the mechanical reels, 114, 116 and 118 with five paylines, designated by reference numerals 122, 124, 126, 128 and 130. A player initiates basic game play by inserting a number of coins or playing a number of credits, causing the CPU 170 (FIG. 8) to activate a number of pay lines corresponding to the number of coins or credits played. In one embodiment, the play of one coin or credit activates pay line 122, two coins or credits activates pay lines 122 and 124, three coins or credits activates pay lines 122, 124 and 126, four coins or credits activates pay lines 122, 124, 126 and 128 and five coins or credits activates all five pay lines 122, 124, 126, 128 and 130. It will be appreciated, however, that the present invention may be implemented on machines having fewer or greater numbers of paylines and/or with payline(s) which are activated independently of the number of coins or credits played. The present invention may also be implemented with video "reels." Accordingly, the terms "reels," "spinning reels," etc., and the like shall be understood herein to encompass video, as well as mechanical, implementations.

After activation of the paylines, a lever 120 is pulled to set the reels 114, 116, 118 in motion. Alternatively, the player may depress a button such as a "SPIN REELS" or "MAX BET" button (not shown) to set the reels in motion. The CPU 170 uses a random number generator (not shown) to select a game outcome (e.g., basic game outcome) corresponding to a particular set of reel stop positions. The CPU 20 then causes each of the reels 114, 116, 118 to stop at the preselected stop position. Winning "basic" game outcomes (e.g., symbol combinations resulting in payment of coins or credits) are identifiable by a pay table (see Table B-1). The pay table may be affixed to the machine 10 and/or displayed on the graphics display 132 in response to player input, for example by pressing a "PAY TABLE" button (not shown).

If the displayed symbols stop in a winning combination, the game credits the player an amount corresponding to the award in the pay table for that combination. In one embodiment, "basic" winning combinations must be displayed relative to an active one of the payline(s) 122, 124, 126, 128, 130. For example, in the illustrated embodiment, if one coin or credit is played, payline 122 is activated and the player is credited a predefined amount of coins or credits if one of the basic combinations identified in the pay table is displayed directly under payline 122 (e.g., with the first, second and third symbols of the combination being displayed, respectively, in the "left-center" position, "middle-center" position and "right-center" position relative to the display window 112). If two coins or credits are played, paylines 122 and 124 are activated and the player is awarded credits if any of the basic combinations in the pay table are displayed directly under payline 122 and/or payline 124. Payline 124 requires that the first, second and third symbols of the combination are displayed, respectively, in the "left-upper" position, "middle-upper" position and "right-upper" position relative to the display window 112. If three coins or credits are played, paylines 122, 124 and 126 are activated and the player is rewarded if any of the basic combinations in the pay table are displayed directly under paylines 122, 124 and/or 126. Payline 126 requires that the first, second and third symbols of the combination are displayed, respectively, in the "left-lower" position, "middle-lower" position and "right-lower" position relative to the display window 112. If four coins or credits are played, paylines 122, 124, 126 and 128 are activated and the player is rewarded if any of the basic winning combinations in the pay table are displayed directly under paylines 122, 124, 126 and/or 128. Payline 128 requires that the first, second and third symbols of the combination are displayed, respectively, in the "left-upper" position, "middle-center" position and "right-lower" position relative to the display window 112. Finally, if five coins or credits are played, paylines 122, 124, 126, 128 and 130 are activated and the player is rewarded if any of the basic winning combinations appearing on the pay table are displayed directly under paylines 122, 124, 126, 128 and/or 130. Payline 130 requires that the first, second and third symbols of the combination are displayed, respectively, in the "left-lower" position, "middle-center" position and "right-upper" position relative to the display window 112.

In a game where multiple credits are wagered on a winning payline, the game credits the player the amount on the pay table multiplied by the amount of credits wagered on the winning payline. The player may collect the amount of accumulated credits at any time by pressing a "Collect" button (not shown).

It will be appreciated, however, that alternative pay schemes may implemented. For example, a winning combination may be defined by the processor to occur when a combination of symbols appears on the reels in a "scatter-pay" configuration. Winning combinations of the "scatter-pay" type occur when the symbols defining the combination appear on each reel in either of three visible display positions (e.g., "upper," "center" or "lower"), even if such positions do not correspond with an active pay line. In one embodiment of the present invention, the appearance of "start-bonus" symbols on the designated number of reels, in scatter-pay format, represents a "start-bonus" outcome causing the CPU 170 to shift operation from the basic game to a bonus game. The symbols defining the start-bonus combinations are preferably identified on the pay table or portion(s) of the gaming machine 110.

Figure 9:
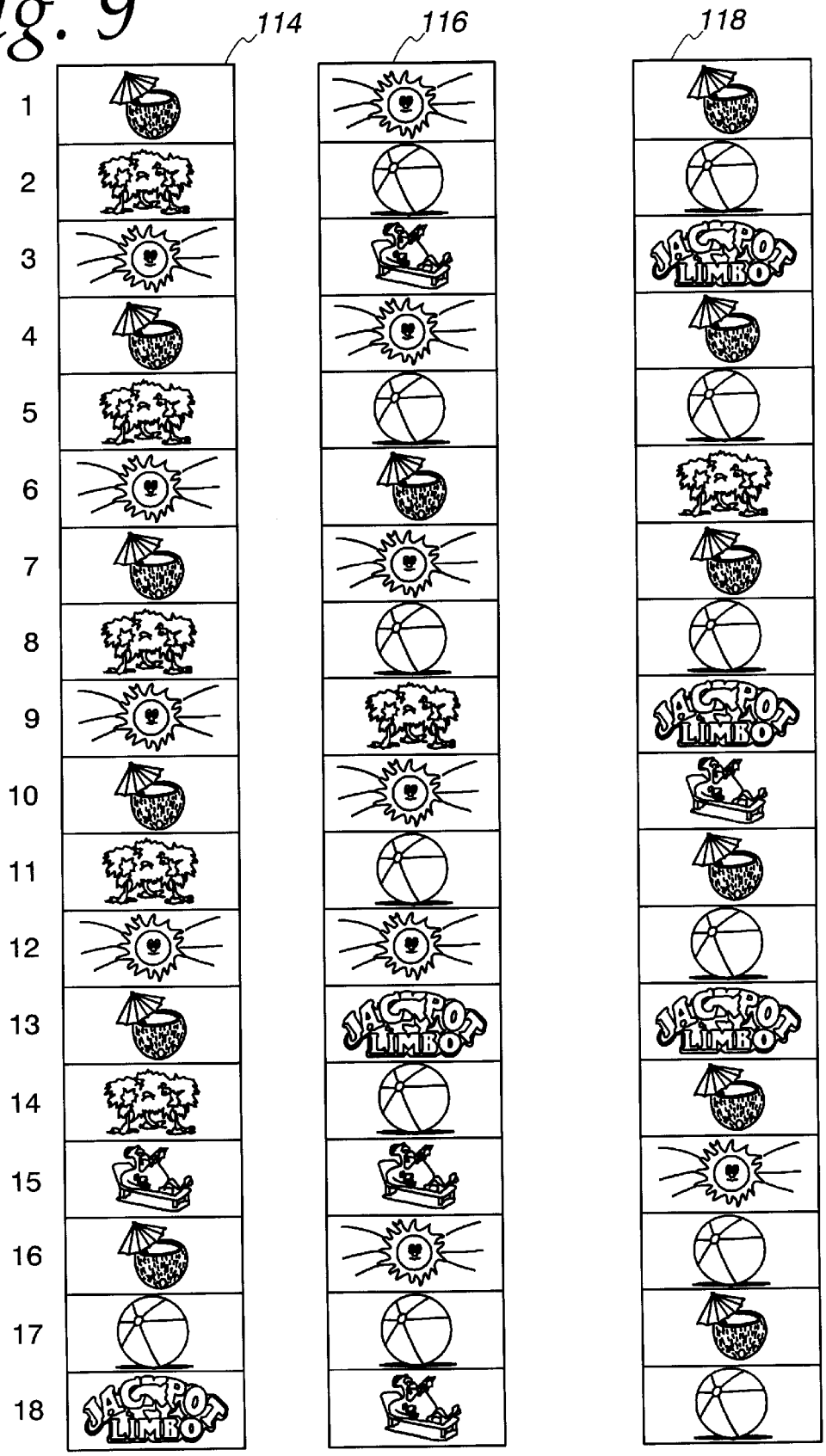
FIG. 9 is an illustration of three reel strips associated with a basic game which may be played on the gaming machine of FIG. 7.
Figure 10A:
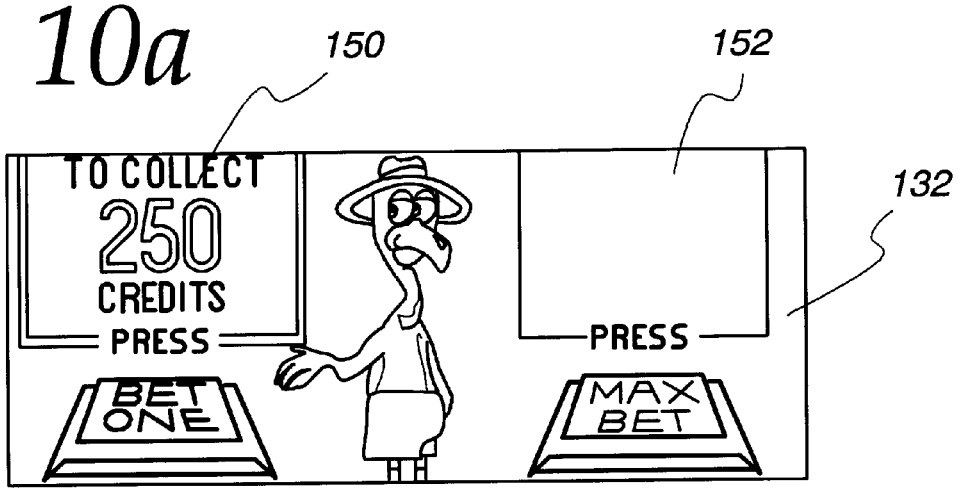
FIG. 10*a* illustrates a first display screen showing strategy options which may be selected in a bonus game played on the gaming machine of FIG. 7.
Figure 10B:
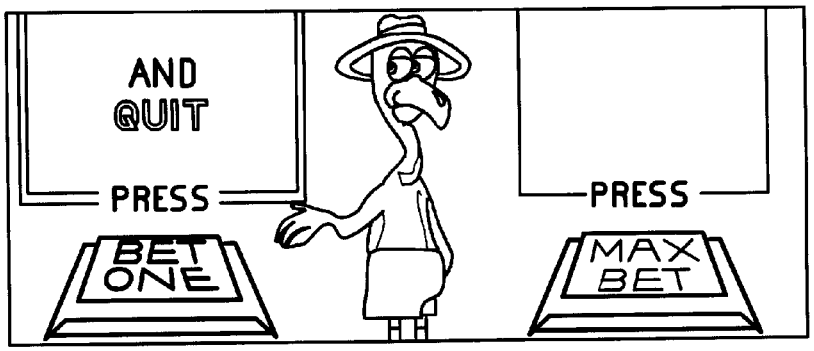
FIG. 10*b* illustrates a second display screen showing strategy options which may be selected in a bonus game played on the gaming machine of FIG. 7.
Figure 10C:
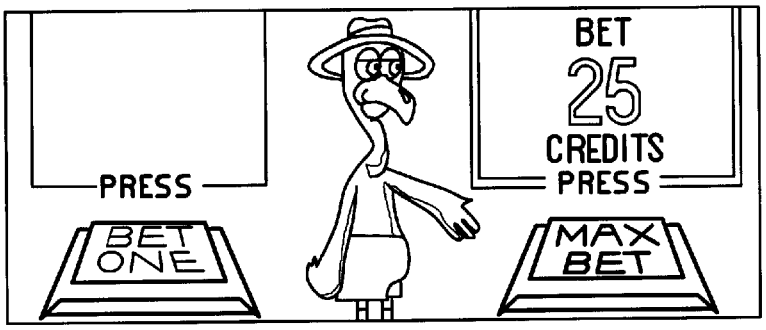
FIG. 10*c* illustrates a third display screen showing strategy options which may be selected in a bonus game played on the gaming machine of FIG. 7.
Figure 10D:
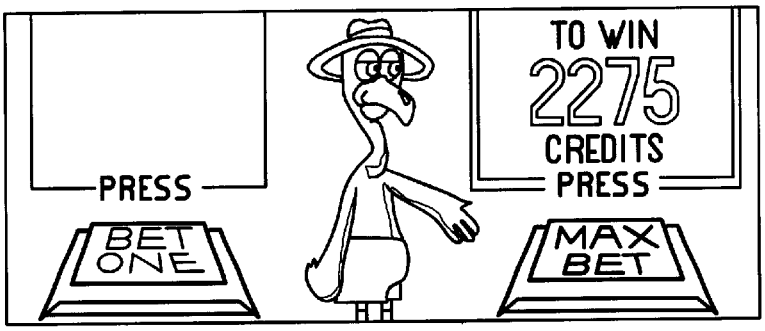
FIG. 10*d* illustrates a fourth display screen showing strategy options which may be selected in a bonus game played on the gaming machine of FIG. 7.
Figure 10E:
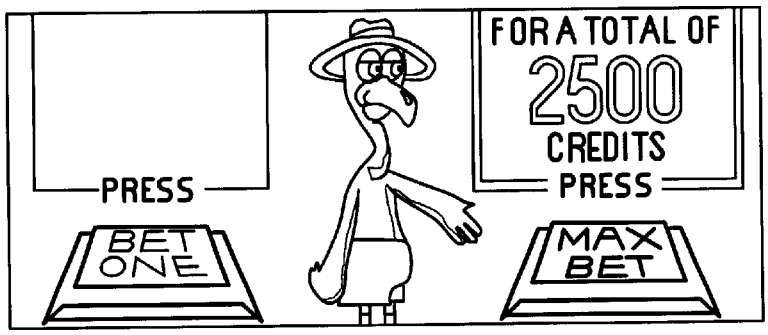
FIG. 10*e* illustrates a fifth display screen showing strategy options which may be selected in a bonus game played on the gaming machine of FIG. 7.

FIG. 9 shows a set of reel strips for use with the slot machine 110 to implement the JACKPOT LIMBO™ game. The reel strips correspond to the reels 114, 116, 118 in FIG. 7 and will be identified by corresponding reference numerals 114, 116, 118. Each of the reel strips 1 14, 116, 118 include eighteen symbols corresponding to eighteen available reel stopping positions. The symbols include FLAMINGO, PALM, SUN, DRINK and BALL symbols which, if displayed in certain predefined combinations relative to an active payline, define the basic winning combinations. Also included on the reel strips 114, 116, 118 are JACKPOT LIMBO (hereinafter "JACKPOT") symbols which, if displayed in scatter-pay format, define start-bonus combinations which will trigger the bonus game.

Specifically, the symbols which appear on reel strip 114 include, in sequence DRINK, PALM, SUN, DRINK, PALM, SUN, DRINK, PALM, SUN, DRINK, PALM, SUN, DRINK, PALM, FLAMINGO, DRINK, BALL and JACKPOT. The symbols which appear on reel strip 116 include, in sequence SUN, BALL, FLAMINGO, SUN, BALL, DRINK, SUN, BALL, PALM, SUN, BALL, SUN, JACKPOT, BALL, FLAMINGO, SUN, BALL, FLAMINGO. Finally, the symbols which appear on reel strip 118 include, in sequence, DRINK, BALL, JACKPOT, DRINK, BALL, PALM, DRINK, BALL, JACKPOT, FLAMINGO, DRINK, BALL, JACKPOT, DRINK, SUN, BALL, DRINK and BALL.

TABLE B-1

PAY TABLE FOR JACKPOT LIMBO GAME

| | | | PAY |
|---|---|---|---|
| FLAMINGO | FLAMINGO | FLAMINGO | 100 |
| PALM | PALM | PALM | 50 |
| SUN | SUN | SUN | 25 |
| DRINK | DRINK | DRINK | 15 |
| DRINK | DRINK | — | 10 |
| BALL | BALL | BALL | 10 |
| BALL | BALL | — | 5 |
| BALL | — | — | 2 |
| JACKPOT | JACKPOT | JACKPOT | 22.4025 |

Table B-1 is a pay table identifying various winning combinations of symbols in the JACKPOT LIMBO™ game. The first eight combinations define basic winning combinations which, if displayed relative to an active payline, will pay from 2 to 100 coins in the basic game. The final combination (e.g., JACKPOT, JACKPOT, JACKPOT) is a start-bonus combination which, if displayed in scatter-pay format, will cause the CPU 170 to enter the bonus game. The value 22.4025 represents an average win amount that might be expected in the bonus game.

The CPU 170 enters the bonus game when a special "start-bonus" outcome of three JACKPOT LIMBO symbols appear in scatter-pay format in the basic game. Upon entering the bonus game, the CPU 170 operates to display a series of bonus game screens on the graphics display. Generally, like the TOP BANANA game, the JACKPOT LIMBO game provides for the player to choose, one at a time, a sequence of game strategy options, each of which is associated with a game activity or "action" having an outcome which affects the bonus game play. The game strategy options, game activities and the possible outcomes of those strategy options/activities are defined by a game program stored in the system memory 186 and executable by the CPU 170. After selection of each respective strategy option, the CPU 170 identifies the game activity associated with the selected strategy option and then "performs" the game activity by selecting an outcome and causing the display 132 to display indicia of the selected outcome. In one embodiment, certain of the game activities have outcomes which are determined randomly by the CPU 170 according to a selection probability defined by the game program, and certain other activities have predetermined outcomes, depending on the selected strategy option and the game program. It will be appreciated that the game activities might have outcomes comprising any combination of randomly determined.outcomes and predetermined outcomes, depending on the game program.

Generally, the course of the bonus game, and consequently the amount of coins or credits which are to be awarded to the player, is determined by the sequence of strategy option(s) selected by the player and the performance of game activities associated with the selected strategy options. The strategy options available to the player, game activities associated with the respective strategy options and the outcomes of those activities may differ, according to the game program, at different stages of the bonus game. The probability of occurrence of certain outcomes may also differ, according to the game program, at different stages of the bonus game. In one embodiment, the player is offered game strategy options or "actions" at each stage and the associated game. activities are performed, one at a time, until an outcome of one of the activities ends the bonus game.

In the JACKPOT LIMBO™ bonus game, for example, the course of the bonus game is generally determined by the player selecting between two strategy options: "Attempt Level" or "Exit." In one embodiment, the strategy options eligible for selection, and instructions for selecting the respective strategy options are displayed on the graphics display 132 (see FIGS. 10*a*–10*e*). In the illustrated embodiment, the display 132 instructs the player to press the "BET ONE" key to select the "Exit" option or to press the "MAX BET" key to select the "Attempt Level" option. Instructions associated with the respective "Exit" and "Attempt Level" options are shown in a running animation in respective display fields 150, 152 (FIG. 10) on the graphics display 132. An example animation is shown in consecutive FIGS. 10*a* through 10*e*. "TO COLLECT 250 CREDITS (FIG. 10*a*) "AND QUIT" (FIG. 10*b*) "PRESS 'BET ONE'" (FIGS. 10*a*, 10*b*) indicates that the player can exercise the "Exit" option (i.e., "QUIT") by pressing the "BET ONE" key. Similarly, "BET 25 CREDITS" (FIG. 10*c*) "TO WIN 2275 CREDITS" (FIG. 10*d*) "FOR A TOTAL OF 2500 CREDITS" (FIG. 10*e*) "PRESS 'MAX BET'" (FIGS. 10*c*, 10*d*, 10*e*) indicates that the player can exercise the "Attempt Level" option by pressing the "MAX BET" key.

Each strategy option is associated with a game activity or action which, in the JACKPOT LIMBO™ game, is logically associated with the name of the strategy option. Specifically, in the JACKPOT LIMBO™ game, the "Attempt Level" option is logically associated with "Attempt Level" action(s) in which the player attempts to reach next consecutive level(s) of the game. The "Attempt Level" actions are represented on the graphics display 132 by an animated flamingo character attempting to limbo dance underneath a series of progressively lower limbo bars (see FIGS. 11*a* and 11*b*). The "Exit" option is logically associated with an "Exit" action in which the player exits the bonus game and collects a reward without attempting the next level.

In one embodiment, the exercise ("performance") of the "Attempt Level" action will result in either of two possible outcomes: "Success" or "Failure," whereas the exercise of the "Exit" action is always successful. A "Success" outcome defines a successful exercise of the action and a "Failure" outcome defines a failed exercise of the action. The likelihood of success or failure of the "Attempt Level" option generally differs according to the stage of the bonus game in which it is exercised.

In one embodiment, when the player enters a first stage of the bonus game, as shown in FIG. 10, the player has both options—"Exit" and "Attempt" level. The player is prompted to select between these options by pressing the "MAX BET" key (not shown) or "BET ONE" key (not shown) on the gaming machine 110.

Figure 11A:
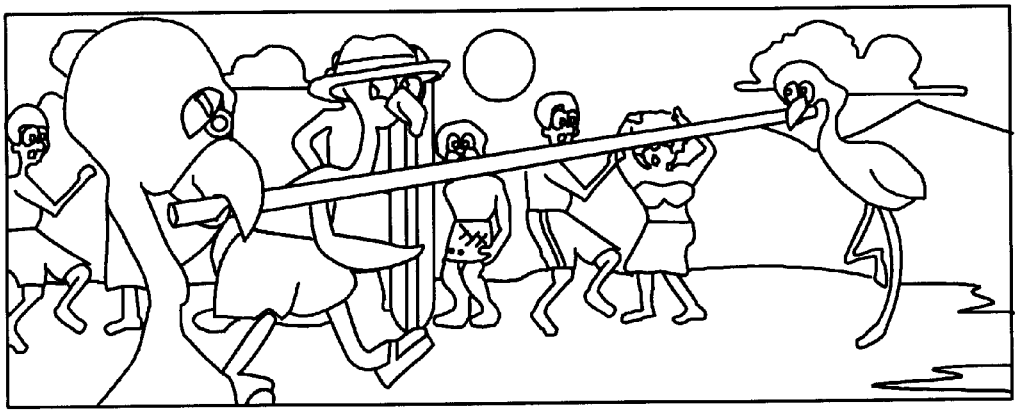
FIG. 11*a* is a first display screen showing a game activity associated with one of the strategy options of FIG. 10.
Figure 11B:
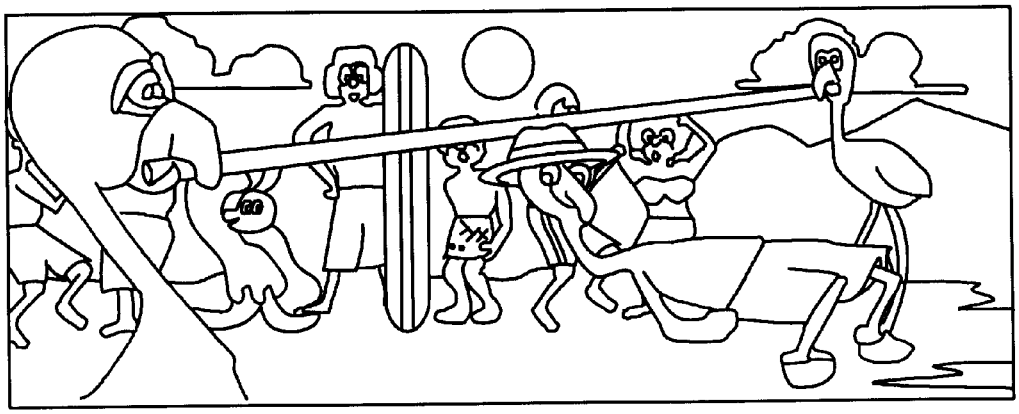
FIG. 11*b* is a second display screen showing the game activity of FIG. 11*a*.

If the player selects the "Attempt Level" action (by pressing the "MAX BET" key), the CPU 170 performs the action by selecting between the "Success" and "Failure" outcomes and then causing the graphics display 132 to show indicia of the successful, or unsuccessful action as appropriate. Specifically, in one embodiment of the JACKPOT LIMBO™ game, each exercise of the "Attempt Level"

action generates a display of an animated flamingo character attempting to limbo dance underneath a limbo bar (see FIGS. 11*a* and 11*b*). The bar is set relatively high at first, then progressively lower as the player advances to next consecutive levels. A successful outcome is illustrated by the flamingo successfully dancing underneath the limbo bar whereas a failed outcome might be illustrated by the flamingo falling or knocking over the limbo bar.

In one embodiment, the "Attempt Level" action may be exercised up to three times with the limbo bar set at a progressively lower heights. The game program defines a progressively lower selection probability of the "Success" outcome of the "Attempt Level" option, roughly corresponding to the height of the limbo bar as the game progresses, as follows: 50% likelihood of success for the first exercise, an 21% likelihood of success for the second exercise and a 10% likelihood of success for the third exercise.

In one embodiment, the player is credited a fixed "stake" or bet amount upon initially entering the bonus game. The stake may be increased upon successfully executing a particular "Attempt Level" action and/or reduced upon a failed "Attempt Level" action. For each successful "Attempt Level" action, the stake value is increased and the bonus game continues to successive stages, each stage generally offering the player a choice between the "Exit" or "Attempt Level" actions. If any of the "Attempt Level" actions fail, the stake value is reduced, the player is awarded the reduced stake value and the bonus game ends. In one embodiment, the bonus game also ends if the player succeeds at the third and final stage, in which case the player is awarded a final stake value.

In one embodiment, if the player exercises the "Exit" option ("action"), the player collects the present stake value and the bonus game ends without attempting any further levels. Thus, the "Exit" option avoids the risk of a reduction in stake value which would occur in a failed "Attempt Level" action, but also precludes the opportunity to achieve even higher stake amounts which would occur in a successful "Attempt Level" action.

TABLE B-2

JACKPOT LIMBO FEATURE TABLE

| | | SUCCESS PROB | STAKE VALUE (SUCCESS) (X BET) | STAKE VALUE (FAIL) (X BET) |
|---|---|---|---|---|
| ROUND ONE | EXIT | 100% | 15 | N/A |
| | ATTEMPT | 50% | 25 | 10 |
| ROUND TWO | EXIT | 100% | 25 | N/A |
| | ATTEMPT | 21% | 50 | 20 |
| ROUND THREE | EXIT | 100% | 50 | N/A |
| | ATTEMP | 10% | 500 | 45 |

Table B-2 is a table identifying various strategies options offered in one embodiment of the JACKPOT LIMBO™ bonus game and their possible outcomes. The entries in the left hand columns (e.g., "Round 1," "Round 2" and "Round 3") correspond to number of times strategy options might be offered in the JACKPOT LIMBO™ bonus game. Round 1, for example, corresponds to the beginning of the bonus game when the player is offered, for the first time, the choice between the "Exit" and the "Attempt Level" options. Rounds 2 and 3 correspond to the second and third times strategy options are offered to the player, depending of course on the earlier choices made by the player and the outcomes of those choices.

The "Exit" entries correspond to the exercise of the "Exit" option and the "Attempt" entries correspond to the exercise of the "Attempt Level" option in the respective rounds. Thus, for example, the "Exit" entry of Round 1 assumes that the player will exercise the "Exit" option in round 1 and the "Attempt" entry of Round 1 assumes that the player will exercise the "Attempt Level" option in Round 1, and so forth.

The "Success Prob" column identifies the a priori probability of success for each individual exercise of the "Exit" or "Attempt Level" options. Thus, in the embodiment of Table B-3, the "Exit" option is always successful, no matter what round it is exercised, whereas the "Attempt Level" option has a 50% likelihood of success in Round 1, a 21% likelihood of success in Round 2 and a 10% likelihood of success in Round 3.

The "Stake Value (Success)" column identifies the value of the "stake" which is achieved if the player successfully executes the respective "Exit" or "Attempt Level" options during the respective rounds, whereas the "Stake Value (Fail)" column identifies the value of the stake which is achieved if the player fails to successfully execute the respective "Exit" or "Attempt Level" options. Thus, in the embodiment of Table B-3, a successful "Exit" in Round 1 will result in a stake value of 15 times the amount bet (e.g., 15 credits in a 1-coin game). There is no indicated "Stake Value (Fail)" amount for any of the "Exit" options because the "Exit" option is always successful. In the embodiment of Table B-3, the player is thereby guaranteed a stake value of at least 15 credits by exercising the "Exit" option.

If the player chooses to execute an "Attempt Level" option in round 1, the stake increases to 25 times the amount bet if the option is successful, but the stake decreases to 10 times the amount bet if the option fails. If the option is successful, the player enters "Round 2" and once again chooses between the "Exit" and "Attempt Level" options. If the player chooses the "Exit" option in Round 2, the player receives the stake value achieved in Round 1 (e.g., 25 credits in a 1-coin game). Otherwise, the player may execute an "Attempt Level" option in round 2, wherein the stake increases to 50 times the amount bet if the option is successful but decreases to 20 times the amount bet if the option fails. Then, if the option is successful in Round 2, the player enters "Round 3" and again chooses between the "Exit" and "Attempt Level" options. If the player chooses the "Exit" option in Round 3, the player receives the stake value achieved in Round 2 (e.g., 50 credits in a 1-coin game). Otherwise, if the player executes an "Attempt Level" option in round 3, the stake increases to 500 times the amount bet if successful and decreases to 45 times the amount bet if the option fails. In the embodiment of Table B-2, if the "Attempt Level" option is successful in Round 3, the player is automatically awarded the stake value achieved in Round 3 (e.g., 500 credits in a 1-coin game) without exercising an "Exit" option and without having the opportunity to attempt any further levels. Alternatively, the present invention might be implemented with fewer or greater numbers of levels and/or may require the player to exercise an "Exit" option after the final level.

It will be appreciated that the present invention has generally been described with reference to the particular games TOP BANANA™ and JACKPOT LIMBO™, each offering multiple strategy options to the player, but the present invention is not limited to the particular embodiments described herein. For example, while the aforementioned games have a basic game in the form of a slot machine, the present invention may be implemented with virtually any type of game of chance or skill or combination of such games having outcomes (e.g., "start-bonus" outcomes) which may trigger play of a bonus game. The basic game may comprise, for example, a video poker or video blackjack game. Other variations within the scope of the present invention include bonus games with different themes, different displays and/or different types of strategy options, basic games with different numbers and types of reels and/or symbols, different payline configurations, and basic or bonus games with different values of coin awards, different probabilities, expected values, etc.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of conducting a wagering game on a gaming machine under control of a processor, the method comprising the steps of:

receiving a wager to play the wagering game;

executing, under processor control during the wagering game, a bonus game program defining a plurality of strategy options;

selecting a number of the strategy options;

performing one or more game activities associated with the selected strategy options, the game activities including respective animated performances of a moving object, the animated performances varying with the selection of different ones of the strategy options; and awarding credits based on an outcome of the performed game activities.

2. The method of claim 1 wherein the step of selecting a number of the strategic option is accomplished under player control.

3. The method of claim 1 wherein the game program defines a plurality of game stages and wherein the strategy options are selected, one at a time, in one or more successive game stages.

4. The method of claim 3 wherein the bonus game program defines a first and second strategy option in at least one of said one or more successive game stages.

5. The method of claim 4 wherein the step of executing the game program comprises displaying a selection screen identifying said first and second strategy option in said at least one of said one or more successive game stages.

6. The method of claim 5 wherein the selection screen comprises a touch-screen display and the step of selecting one of said first and second strategy options is accomplished by the player touching the touch-screen display over a selected one of said first and second strategy options.

7. The method of claim 4 wherein the step of selecting strategy options comprises selecting, under player control, one of said first and second strategy options in said at least one of said one or more successive game stages.

8. The method of claim 7 wherein the step of performing game activities comprises, in said at least one of said one or more successive game stages:

identifying, under processor control, a designated game activity associated with the selected one of said first and second strategy options, identifying, under processor control, a number of possible outcomes associated with the designated game activity; and selecting, under processor control, one of the possible outcomes associated with the designated game activity.

9. The method of claim 8 wherein the selecting step comprises randomly selecting one of the possible outcomes according to a selection probability defined by the game program.

10. The method of claim 9 wherein the game program defines a progressively lower selection probability for one of the possible outcomes in the successive game stages.

11. The method of claim 9 wherein the game program defines a progressively higher selection probability for one of the possible outcomes in the successive game stages.

12. The method of claim 8 wherein the step of identifying a number of possible outcomes comprises identifying a first and second possible outcome associated with the designated game activity.

13. A method of conducting a wagering game on a gaming machine under control of a processor, the method comprising the steps of:

receiving a wager to play the wagering game;

executing, under processor control during the wagering game, a bonus game program defining a first and second strategy option each associated with a designated game activity;

selecting, under player control, one of said first and second strategy options;

identifying, under processor control, the designated game activity associated with the selected strategy option and a number of possible outcomes of the designated game activity;

selecting, under processor control, one of the possible outcomes of the designated game activity thereby defining a selected outcome;

displaying the designated game activity associated with the selected strategy option by showing an animated performance of a moving object, the animated performance varying with the selection of different ones of the possible outcomes;

displaying indicia of the selected outcome of the designated game activity; and awarding a payout based on the selected outcome.

14. The method of claim 13 wherein one of the possible outcomes defines a successful exercise of the designated game activity by the animated moving object and the other of the possible outcomes defines a failed exercise of the designated game activity by the animated moving object.

15. The method of claim 14 wherein the step of executing the game program comprises advancing between successive game stages in response to a successful exercise of the designated game activity by the animated moving object.

16. The method of claim 14 wherein the step of executing the game program comprises ending the bonus game in response to a failed exercise of the designated game activity by the animated moving object.

17. The method of claim 14 further comprising the step of awarding a predefined credit value in response to a successful exercise of the designated game activity by the animated moving object.

18. The method of claim 14 wherein the step of executing the game program comprises reaching a target object in response to a successful exercise of the designated game activity by the animated moving object.

19. The method of claim 14 further comprising the step of awarding a target credit value in response to a successful exercise of the designated game activity by the animated moving object.

20. The method of claim 14 wherein the step of executing the game program comprises failing to reach a target object in response to a failed exercise of the designated game activity by the animated moving object.

21. The method of claim 14 wherein the step of executing the game program comprises reducing a target credit value in response to a failed exercise of the designated game activity by the animated moving object.

22. The method of claim 14 wherein the step of executing the game program comprises increasing a stake credit value in response to a successful exercise of the designated game activity by the animated moving object.

23. The method of claim 14 wherein the step of executing the game program comprises decreasing a stake credit value in response to a failed exercise of the designated game activity by the animated moving object.

24. The method of claim 13 wherein one of said first and second strategy options comprises an exit option, the step of executing the game program comprising ending the bonus game in response to a selection of the exit option.

25. The method of claim 24 further comprising the step of awarding a stake credit value in response to a selection of the exit option.

26. A gaming machine for conducting a wagering game in response to a wager, the machine comprising:

a processor operable to execute, during the wagering game, a bonus game program defining first and second strategy options associated with one or more successive game stages, each of the first and second strategy options being associated with one or more respective game activities, the game activities including respective animated performances of a moving object, the animated performances varying with the selection of different ones of the strategy options;

a selection element for selecting, under player control, a selected one of said first and second strategy options in each of the successive game stages;

an outcome-determination element for determining, under processor control, an outcome for each of the selected strategy options;

a display for displaying the one or more game activities and the outcome of the selected strategy option; and a payout mechanism for awarding credits based on the outcomes of the selected strategy options.

27. A method of conducting a wagering game on a gaming machine controlled by a processor, the method comprising:

receiving a wager to play the wagering game;

executing, under processor control during the wagering game, a bonus game program defining a plurality of strategy options;

making selections of a number of the strategy options;

performing game activities associated with the respective selected strategy options;

displaying one of a plurality of possible outcomes for each of the respective game activities, each of the possible outcomes having an associated probability of occurring, the probability varying with successive ones of the selections; and awarding a payout based on the displayed outcome.

28. The method of claim 27, wherein the game activities include animated performances of moving objects on a video display.

29. The method of claim 28, wherein the outcomes correspond to the degree of success of the animated moving objects in performing the game activities.

* * * * *